US006250278B1

(12) United States Patent
Mekler

(10) Patent No.: US 6,250,278 B1
(45) Date of Patent: Jun. 26, 2001

(54) ROTARY MACHINE

(76) Inventor: Dan Mekler, 5 Korei Hadorot Street, Talpiot (IL), 93387

( * ) Notice: Subject to any disclaimer, the term of this patent is extended or adjusted under 35 U.S.C. 154(b) by 0 days.

(21) Appl. No.: 09/099,521

(22) Filed: Jun. 18, 1998

(51) Int. Cl.[7] ..... F02B 53/00

(52) U.S. Cl. ..... 123/241; 123/246; 418/200; 418/204

(58) Field of Search ..... 123/241, 246, 123/213, 234; 418/204, 191, 192, 199, 200, 205, 206.4, 235; 60/39.55

(56) References Cited

U.S. PATENT DOCUMENTS

| | | | | |
|---|---|---|---|---|
| 1,240,112 | * | 9/1917 | Winger | 123/246 |
| 1,294,869 | * | 2/1919 | Bump | 418/206.4 |
| 1,656,538 | * | 1/1928 | Smith | 123/246 |
| 1,751,843 | * | 3/1930 | Rosett | 418/204 |
| 2,453,284 | * | 11/1948 | Törnborg | 418/204 |
| 2,845,909 | | 8/1958 | Pitkanen . | |
| 3,078,807 | | 2/1963 | Thompson . | |
| 3,726,617 | | 4/1973 | Daido . | |
| 4,152,100 | * | 5/1979 | Poole et al. | 418/196 |
| 4,666,383 | | 5/1987 | Mendler, III . | |
| 4,901,694 | * | 2/1990 | Sakita | 123/234 |
| 5,152,683 | | 10/1992 | Signorelli . | |
| 5,222,992 | * | 6/1993 | Fleischmann | 123/213 |
| 5,466,138 | * | 11/1995 | Gennaro | 418/191 |
| 5,568,796 | * | 10/1996 | Palmer | 418/235 |

FOREIGN PATENT DOCUMENTS

| | | | |
|---|---|---|---|
| 696 469 C | | 8/1940 | (DE) . |
| 2232592 | | 1/1974 | (DE) . |
| 2412888 | * | 10/1975 | (DE) . |
| 24 22 966 | | 11/1975 | (DE) . |
| 44 39 942 A1 | | 5/1996 | (DE) . |
| 2690201 | | 4/1992 | (FR) . |
| 2018899 | | 10/1979 | (GB) . |

OTHER PUBLICATIONS

*Popular Science*, May 1994, p. 46, "Wheeze–Free Rotary".
*Popular Science*, Aug. 1983, pp. 47–50, "The Wankel takes off".
*Popular Science*, Apr. 1983, p. 83, "Smokey's Phase I" diagram.
*Popular Science*, Apr. 1984, pp. 78–80, "Detroit's big switch to Turbo Power".
*Popular Science*, Feb. 1987, pp. 74–76, "Can the two–stroke make it this time?".
*Popular Science*, Jun., 1994, p. 96, "Where the Energy Goes".
*Popular Science*, Apr. 1985, p. 89, "Syalon—super–strong ceramic for engines, tools".
*Popular Science*, Mar. 1982, pp. 64–66, "A family of heat–resistant, super–tough ceramics can deliver big fuel savings".
*Popular Science*, Dec. 1982, pp. 54–56, "From Japan's labs: Ceramic Diesels".

* cited by examiner

*Primary Examiner*—Thomas Denion
*Assistant Examiner*—Tu M. Nguyen
(74) *Attorney, Agent, or Firm*—Nixon & Vanderhye P.C.

(57) ABSTRACT

A rotary machine in which plural, cylindrical rotors are provided for rotation within partially overlapping cylindrical bores, formed within a machine housing. The rotors are eccentrically mounted for synchronized, same directional rotation, within their respective bores, and each is arranged to alternately provide intake and exhaustion of working gaseous fluids, such that each rotor is continually either admitting or exhausting a working gas. The machine is constructed such that the rotors are cylindrical, each being of internally balanced form. The rotors do not touch each other or any portion of the machine casing at any time, while being positioned so as to define minimal gaps therebetween. A high rotational speed may be developed, thereby obviating the need for seals entirely, and thus further increasing the available speed, and thus the work efficiency of the machine.

19 Claims, 18 Drawing Sheets

ROTARY MACHINE

FIELD OF THE INVENTION

The present invention relates to rotary machines, including rotary engines, rotary motors, and compressors.

BACKGROUND OF THE INVENTION

The advent of rotary engines was intended to supplant reciprocating engines, thereby to reduce energy losses caused by the reciprocation of pistons, to reduce the number of moving parts, and also, friction losses. In this way it was intended to increase the number of revolutions per minute, and also to increase engine efficiency.

Rotary engines may include a pair of rotors arranged for rotation within a sealed engine cavity. The rotors are connected to an output shaft or driver. A combustible fuel mixture is provided to the engine cavity and ignited. An increase in pressure in the engine cavity due to ignition of the fuel-air mixture results in a driving force being applied to the rotors, thereby causing rotation of the driver.

There are also known rotary pumps and motors which have certain similarities to the above-described engine. An indication of the state of the art may be obtained by referring to the following patent publications:

U.S. Pat. No. 3,078,807, entitled Dual-Action Displacement Pump;

French Patent No. 9204757, publication no. 2,690,201;

U.S. Pat. No. 3,726,617, entitled Pump or a Motor Employing a Couple of Rotors in the Shape of Cylinders with an Approximately Cyclic Section; and U.S. Pat. No. 5,152,683, entitled Double Rotary Piston Positive Displacement Pump with Variable Offset Transmission Means.

The above patents generally do not provide structures which are conducive for use as internal combustion engines.

In the field of internal combustion engines, it is desirable to sustain high operating temperatures, thereby to maximize engine efficiency, in accordance with the well known Carnot Law.

In the field of rotary internal combustion engines, there are known the following publications: U.S. Pat. No. 2,845,909, entitled Rotary Piston Engine, to Pitkanen; and U.S. Pat. No. 4,666,383, entitled Rotary Machine, to Mendler.

Pitkanen teaches a rotary piston engine having a pair of cam-shaped rotors which are arranged for parallel rotation inside an engine casing. Pitkanen is unable to work at high speeds due to the shape of the rotors, and, furthermore, seeks to cool the engine, thereby preventing an increase in temperature which, in Pitkanen's engine, is undesired. This results in an inefficient engine, based on the well known Carnot Law, in which efficiency is proportional to the temperature difference between the interior and exterior of the engine, which Pitkanen does not sustain.

Mendler teaches a rotary piston engine having a pair of cam-shaped rotors which are arranged for parallel rotation inside an engine casing. Each rotor is described in the cited patent (column 8, lines 1–6) as having "major and minor cylindrical surfaces . . . , each centered on the axis A of the rotor, and diametrically opposed, . . . joined by cylindrical transition surfaces . . . " Furthermore, a plurality of seals are provided, thereby to provide rotor-to rotor and rotor-to-bore-wall seals (column 7, lines 62–64). It will be appreciated that, due to the presence of seals, the engine taught by Mendler is not only unable to sustain high rotational speeds, due to friction losses, but also cannot operate at high temperatures, due to the necessary presence of lubricating oil in the engine cavity.

SUMMARY OF THE INVENTION

It is thus an aim of the present invention to provide a rotary machine which is characterized by an increased speed, a reduction in energy losses, and a reduction in emissions caused by the burning of lubrication fluids.

In order to provide the above improvements, there is provided a rotary machine in which plural, cylindrical rotors are provided for rotation within partially overlapping cylindrical bores, formed within a machine housing. The rotors are eccentrically mounted for synchronized, same directional rotation, within their respective bores, and each is arranged to alternately provide intake and exhaustion of working gases, such that each rotor is continually either admitting or exhausting a working gas.

Furthermore, the machine is constructed such that the rotors are cylindrical, each being of internally balanced form. The rotors do not touch each other or any portion of the machine casing at any time, while being positioned so as to define minimal gaps therebetween. Accordingly, a high rotational speed may be developed, thereby obviating the need for seals entirely, and thus further increasing the available speed, and thus the work efficiency of the machine.

While the machine of the invention may be constructed either as a motor or a compressor, it is preferably constructed as an internal combustion engine.

It will thus be appreciated that, the absence of any touching parts obviates the need for lubrication inside the engine casing, thereby enabling relatively high working temperatures to be developed therewithin. In order to take advantage of this, it is desired to form the rotors and the engine casing of a suitable ceramic material, having low thermal expansion and high thermal insulation properties; the use of ceramics for this purpose is facilitated by the fact that none of the moving parts touch, as well as the cylindrical shape and balancing of the rotors. The engine casing and rotors also have mechanical strength adequate for their intended use.

It will be appreciated that the use of ceramic materials having high thermal insulation properties, as described, enables high temperature differences between the interior and exterior of the engine to be sustained, thereby increasing the efficiency of the engine, and also obviates the need for cooling systems which would be very wasteful of energy.

It will also be appreciated that the lack of lubrication inside the engine casing serves to reduce pollution.

There is thus provided, in accordance with a preferred embodiment of the invention, a machine which includes:

a housing having formed therein a generally elongate cavity, the cavity being formed by a pair of adjoining, partially overlapping cylindrical bores, each bore being separated from an adjoining bore by a pair of non-joining partition walls;

a pair of cylindrical rotors arranged in said pair of adjoining bores, each rotor being disposed in one of the bores for synchronized, non-touching and same-directional rotation with the other of the pair of rotors;

a pair of rotor shafts associated with each pair of cylindrical rotors, each rotor shaft extending through one of the bores, and mounted transversely to each rotor so as to provide eccentric rotation thereof in the bore;

a gear assembly and a driver associated with the rotor shafts, the assembly and the driver, cooperating to provide synchronized same directional rotation of the rotor shafts; and a plurality of gas ports formed in the housing and communicating with the elongate cavity thereof, for permitting selectable intake and exhaust of working gases, wherein, introduction of a working gas into interactive association with the rotors causes rotation of the pair of rotors and thus also of the driver.

Additionally in accordance with a preferred embodiment of the invention, each bore has a geometric center, and each rotor is mounted for rotation about a rotation axis spaced from the geometric center by a predetermined eccentricity; each cavity is bounded by a pair of parallel wall surfaces transverse to the rotation axis; the plurality of gas ports includes one or more pairs of gas ports provided in communication with each bore, wherein a first of the gas ports is arranged at a first radius from the geometric center and a second of the gas ports is arranged at a second radius from the geometric center, wherein the second radius has a magnitude smaller than that of the first radius; and each rotor is operative to rotate within one of the bores so as to periodically uncover the first port, thereby to enable a flow therethrough of a working gas.

Further in accordance with a preferred embodiment of the present invention, the pair of rotors are disposed in substantially equal angular orientation relative to the rotation axes thereof.

Additionally in accordance with a preferred embodiment of the invention, each rotor has a pair of flat, parallel surfaces disposed in dynamic, non-touching, sealing relation with the pair of parallel wall surfaces of each cavity, and each rotor has formed therein a throughflow portion which is formed so as to be brought periodically into communicative association with the interior of the cavity and with the second gas port, so as to facilitate gas communication therebetween.

Further in accordance with a preferred embodiment of the present invention, each pair of rotors includes first and second rotors, each having a cylindrical outer surface, arranged for rotation within a predetermined pair of adjoining, respective, first and second bores such that the cylindrical outer surfaces of the first and second rotors are always in dynamic, non-touching, sealing relation with each other.

In accordance with one embodiment of the invention, the machine is an internal combustion engine. In this embodiment, the rotors are operative, during the rotation thereof, to cooperate with the partition walls and predetermined portions of the side walls so as to periodically form combustion chambers therewith, and wherein the housing and the rotors are formed of a substantially non-heat conducting material, such as a suitable ceramic material, thereby to enable an elevated temperature to be sustained within the combustion chambers during operation of the machine.

In accordance with the present embodiment, the first port is an air intake port, and the second port is an exhaust port, and each pair of rotors are operative to rotate through a power cycle having first and second portions.

During the first portion of the power cycle, the engine operates as follows:

initially, the first and second rotors are operative to rotate into first positions whereat they are initially spaced from a first side of the cavity so as to define a first combustion chamber therewith, and the first rotor is operative to uncover the air intake port in the first bore thereby to admit air into the space;

subsequently, the first rotors and second rotors are operative to rotate into second positions so as to reduce the volume of the first combustion chamber and thus compress the air therein; and finally, the first rotors and second rotors are operative to be rotated into third positions in response to an expansion of the working gas in the first combustion chamber, and such that the second rotor is operative to bring the throughflow portion thereof into communicative association with the interior of the cavity and with the exhaust port in the second bore, so as to facilitate exhausting of working gas from the second combustion chamber.

During the second portion of the power cycle, the engine operates as in the first portion of the power cycle, but at an offset of 180 degrees therefrom, such that the functions of the two rotors are interchanged.

Preferably, during the first portion of the working cycle, as the first rotors and second rotors rotate into the third positions, the first rotor is operative to uncover the intake port in the first bore, thereby to permit a throughflow between the intake port in the first bore, the first combustion chamber, the throughflow portion of the second rotor, and the exhaust port in the second bore;

and similarly, during the second portion of the working cycle, as the first rotors and second rotors rotate into the sixth positions, the second rotor is operative to uncover the intake port in the second bore, thereby to permit a throughflow between the intake port in the second bore, the second combustion chamber, the throughflow portion of the first rotor, and the exhaust port in the first bore.

Additionally in accordance with a preferred embodiment of the invention, there are also provided at least first and second fuel injectors for injecting fuel into the first and second combustion chambers so as to provide fuel-air mixtures therein and so also as to enable combustion of the fuel-air mixtures, thereby to provide a rotational force on the second rotor during the first portion of the working cycle, and on the first rotor during the second portion of the working cycle.

Further in accordance with a preferred embodiment of the present invention, there is also provided ignition apparatus associated with the first and second combustion chambers, for selectably igniting the fuel-air mixtures therein.

In accordance with an alternative embodiment of the invention, the above machine may be modified so as to function either as a motor or a compressor.

In the event that the machine is constructed as a motor, the above exhaust ports are connected to an external source of pressurized gas, and function as inlet ports, such that the pressurized gas is employed so as to drive the rotors, and the above described air intake ports function as exhaust ports for the working gas. Furthermore, the machine is modified such that the exhaust ports are located at a greater distance from the geometric centers of the bores than the inlet ports.

In accordance with a further embodiment of the invention, there is provided an integrated machine system which includes a plurality of mutually cooperating machines, each having a housing having formed therein a generally elongate cavity, the cavity being formed by a pair of adjoining, partially overlapping cylindrical bores, each bore being separated from an adjoining bore by a pair of non-joining partition walls;

a pair of cylindrical rotors arranged in the pair of adjoining bores of the housing, each rotor being disposed in one of the bores for synchronized, non-touching and same-directional rotation with the other of the pair of rotors; and at least first and second gas ports formed in the housing and communicating with the elongate cavity thereof, for permitting selectable intake and exhaust of working gases.

The system also includes a pair of rotor shafts associated with each pair of cylindrical rotors, each rotor shaft extending through a single bore of all of the housing cavities, and mounted transversely to each rotor so as to provide eccentric rotation thereof in the bore; and a gear assembly and a driver associated with the rotor shafts, the assembly and the driver, cooperating to provide synchronized same directional rotation of the rotor shafts, wherein, introduction of a working gas into interactive association with the rotors causes rotation of the pairs of rotors in the machines and thus also of the driver.

Additionally in accordance with the present embodiment, the plurality of mutually cooperating machines includes at least first and second machines of which the first machine is an internal combustion engine, and others of the machines may be a compressor and a motor.

Further in accordance with a preferred embodiment of the present invention, predetermined ones of the first and second gas ports of each machine are operative to communicate with predetermined others of the first and second gas ports of each machine, thereby to selectably provide an additional rotational force to the driver.

In accordance with a further alternative embodiment of the invention, there is provided a machine for rotating a shaft, which includes:

a housing having at least one chamber defined by walls, a plurality of intake and exhaust ports in the housing for the intake and exhaust of working fluids into and out of the chamber, and propulsion apparatus having at least one surface spaced apart from the walls via a narrow gap of varying dimensions, the propulsion apparatus being operationally associated with the shaft and mounted in the at least one chamber to produce a rotational movement of the shaft upon interaction between the propulsion apparatus, the fluid and the walls, wherein, when the propulsion apparatus is rotated at at least a predetermined speed, there occurs substantially no leakage of working fluid between the at least one surface and the walls when the narrow gap is at a minimum.

In accordance with yet an additional alternative embodiment of the invention, there is provided a machine for rotating a shaft, which includes:

a housing having at least one chamber defined by walls and having formed therein a pair of intercommunicating bores, a plurality of intake and exhaust ports in the housing for the intake and exhaust of working fluids into and out of the chamber, and a pair of propulsion elements operationally associated with the shaft and mounted in the intercommunicating bores to produce a rotational movement of the shaft upon interaction between the propulsion elements, the fluid and the walls, wherein, when the propulsion elements are rotated at at least a predetermined speed, there occurs substantially no leakage of working fluid therebetween.

BRIEF DESCRIPTION OF THE DRAWINGS

The present invention will be more fully understood and appreciated form the following detailed description, taken in conjunction with the drawings, in which.

DETAILED DESCRIPTION OF THE INVENTION

Figure 1:
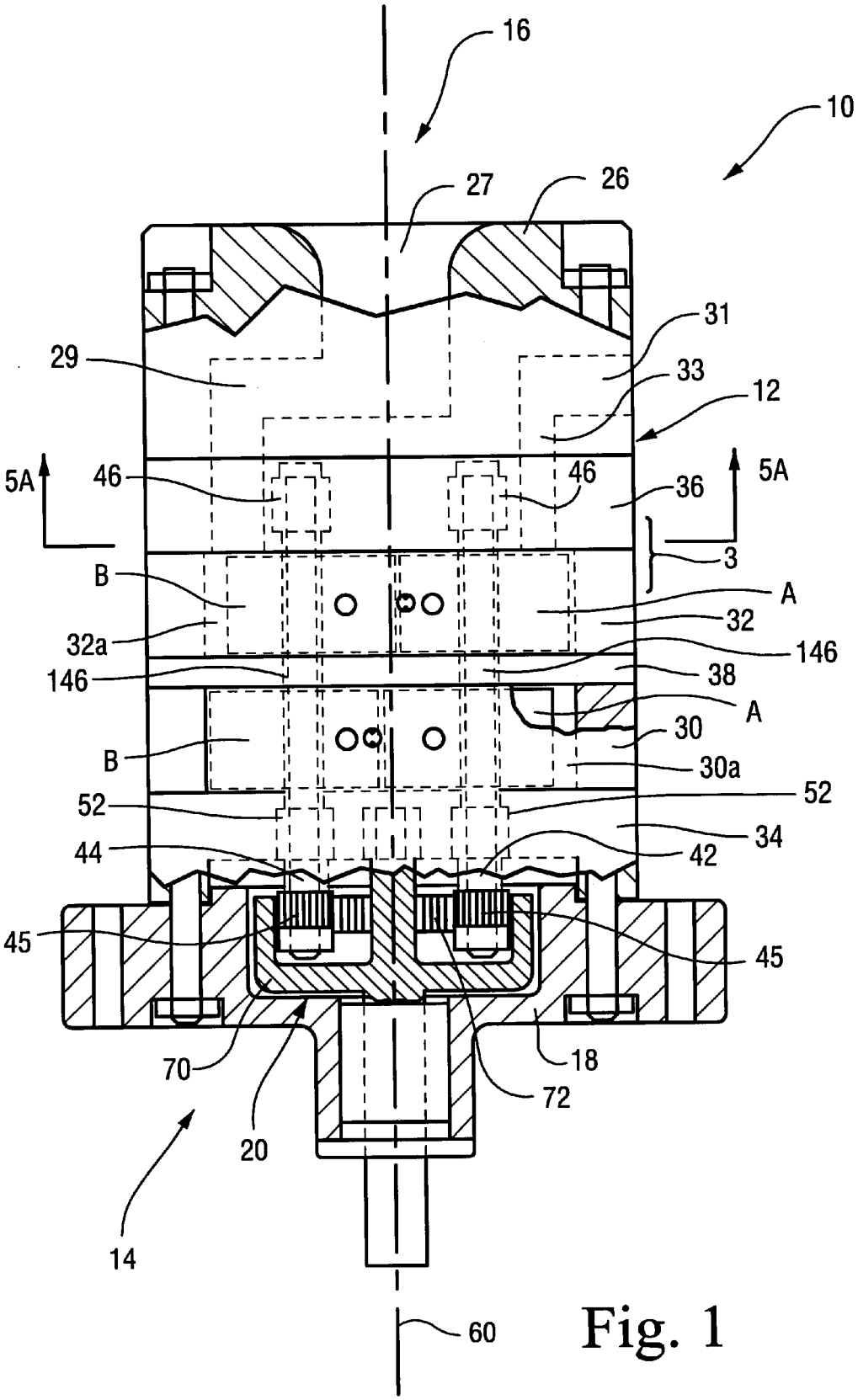
FIG. 1 is a partially cut-away, schematic side view of a rotary machine formed in accordance with a preferred embodiment of the invention, exemplified herein as an internal combustion engine.

Referring now to FIG. 1, there is seen an improved rotary machine, referenced generally 10, constructed and operative in accordance with a preferred embodiment of the present invention. In accordance with the present embodiment, machine 10 is formed as an internal combustion engine, although, as shown and described below in conjunction with FIGS. 9A–10B, it may alternatively be formed as a motor, as described hereinbelow in conjunction with FIGS. 9A–10B, or as a compressor, described hereinbelow in conjunction with FIGS. 13A–13F. Accordingly, all portions of the machine which are shown and described in conjunction with the present embodiment, and which are also provided in either of the embodiments of FIGS. 9A–10B, or 13A–13F, are designated with corresponding reference numerals, and are not described again hereinbelow, except as may be necessary to understand that particular embodiment.

Returning now to the present embodiment, internal combustion engine 10, also referred to hereinbelow by its acronym ICE, has a body 12, which is substantially sealed from the atmosphere. Body 12 has a first end 14 and a second end 16. First end 14 has thereat a gear housing 18 for housing a gear assembly 20 (seen also in FIG. 2), whose function is to synchronize the motion of a plurality of rotors, as described below in conjunction with FIGS. 3–7E. Second end 16 of body 12 preferably includes a manifold and distributor unit 26. A plurality of rotor housings, exemplified herein by a first and second housings, respectively referenced 30 and 32, are disposed between gear housing 18 and manifold and distributor unit 26, and are preferably separated therefrom by respective bearing plates 34 and 36.

Housings 30 and 32 define first and second working cavities, respectively referenced 30*a* and 32*a*. Cavities 30*a* and 32*a* are separated from each other by a partition 38 which facilitates sealing therebetween.

Manifold and distributor unit 26 has an air intake 27 which is connected via a plurality of inlet conduits, depicted schematically at 29, for supplying air to the working cavities; and an exhaust outlet 31, for exhausting exhaust gases from the working cavities via a plurality of exhaust conduits, depicted schematically at 33. In the present embodiment, in which machine 10 is an ICE, the exhaust gases are waste gases resulting from combustion of an air-fuel mixture.

A selected liquid fuel, typically hydrocarbon, is supplied to combustion chambers C1 and C2 (FIGS. 7A–7G) preferably by suitable fuel injectors, at one or more suitable locations in the working cavities. By way of example only, the fuel injection locations are determined preferably in accordance with the type of fuel that it is intended to use, namely, a diesel oil type fuel or a gasoline type.

In the event that a gasoline type fuel is intended to be used, it is preferred to inject it at a relatively more upstream location, referenced 40*a*, substantially prior to compression.

Figure 5A:
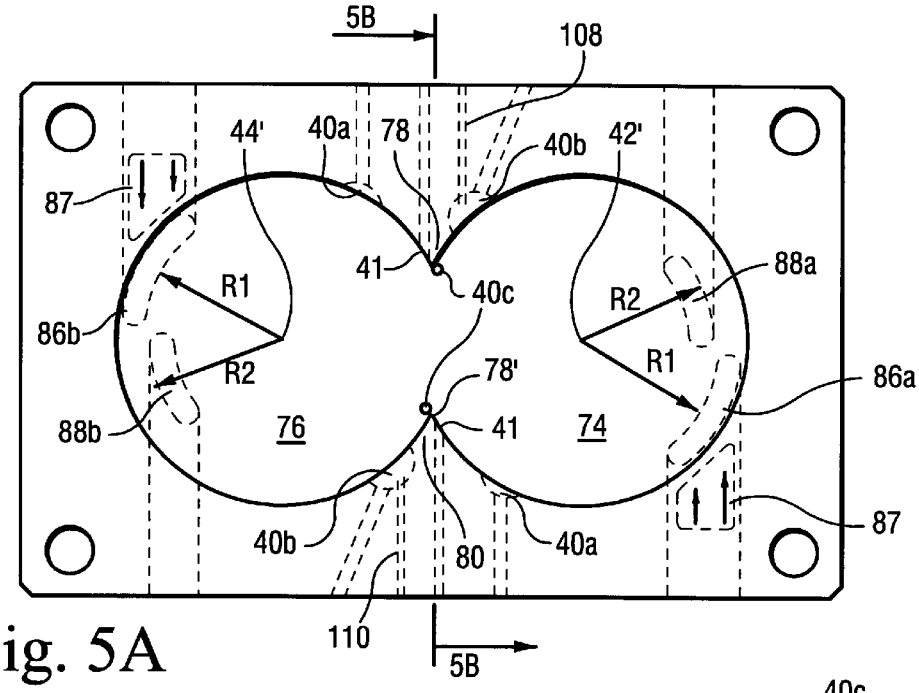
FIG. 5A is a cross-sectional view of the machine of FIG. 1, taken along line 5A therein, showing a rotor housing used therein, but in the absence of the rotors.
Figure 5B:
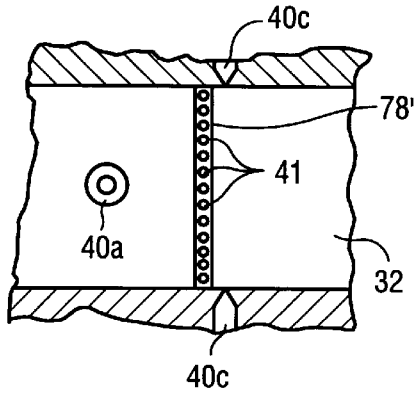
FIG. 5B is an elevation of a nonjoining partition wall seen in FIG. 5A, taken along line 5B—5B therein.

Referring now briefly to FIGS. 5A and 5B, in order to prevent the possibility of combustion occurring in the combustion chamber earlier than desired, due to a fuel-air mixture being brought into contact with a very hot surface portion of a leading rotor, a gas screen may be provided immediately upstream of the rotor, thereby delaying contact between the combustible mixture and the rotor. Typically, this screen may be provided by introducing into the combustion chamber streams of pressurized gas, preferably air, via nozzles 41.

In the event that a diesel oil type fuel is to be used, it is preferred to inject it at one or more relatively more downstream locations, referenced 40*b* and 40*c*, so that the fuel is injected into a compressed air volume.

The fuel injector may be any suitable high speed electronic injector, or, for example, as manufactured by Orbital Engine Company (Australia) Pty. Limited, of Balcatta, Australia, and similar to that described in the article entitled CAN THE TWO-STROKE MAKE IT THIS TIME?, published on pages 74–76 of the February 1987 publication of POPULAR SCIENCE.

Repeated combustion at the same portions of the rotors and housing, in substantially insulated chambers, causes a significant increase in temperature during operation of the engine in the chambers, to temperatures well above the ignition temperatures of fuels used therein. Therefore, the engine components, including rotors A and B, housings 30 and 32, bearing plates 34 and 36, and partition plate 38, is built from materials that are capable of withstanding very high temperatures.

By way of example, the rotors and housing may be formed of ceramics such as direct sintered silicon carbide, of which the maximum use temperature is 1650° C., and reaction bonded silicon nitride, having a maximum use temperature of 1650° C.

However, the mere fact that the fuel air mixture ignites so as to provide heat, and the rotor associated therewith is seen to have worked, i.e. by rotation, this necessarily is accompanied by a decrease in temperature. Moreover, the supply of cool air with fuel, and similarly, the exit of exhaust gases from the engine, together with the accompanying entry of cool air into the engine, moderates the temperature increase to a point at which thermal equilibrium is reached. The point of thermal equilibrium is, however, higher than the combustion temperature of fuels used in conjunction with the engine of the invention.

By way of example, as known by persons skilled in the art, diesel fuel normally requires an air compression ratio of at least 1:19 in order to reach an ignition temperature. In the present invention however, even though the compression ratio may be well below 1:19, the elevated temperature of the surfaces after initial operation of the engine, is, as described above, sufficient to maintain ignition during successive combustion cycles, without requiring either sparking or increased air compression.

Referring now also to FIGS. 2, 3, and 7A–7G, there are preferably provided first and second rotors, respectively referenced A and B, for rotation within a corresponding pair of bores, respectively referenced 74 and 76, (FIGS. 3 and 7A–7G) formed within each housing cavity 30*a* and 32*a*. As will be understood from the description below of FIGS. 7A–7G, the two rotors A and B are mounted so as to have an identical angular disposition and, furthermore, their rotation is synchronized, so as to maintain this angular disposition.

Figure 7A:
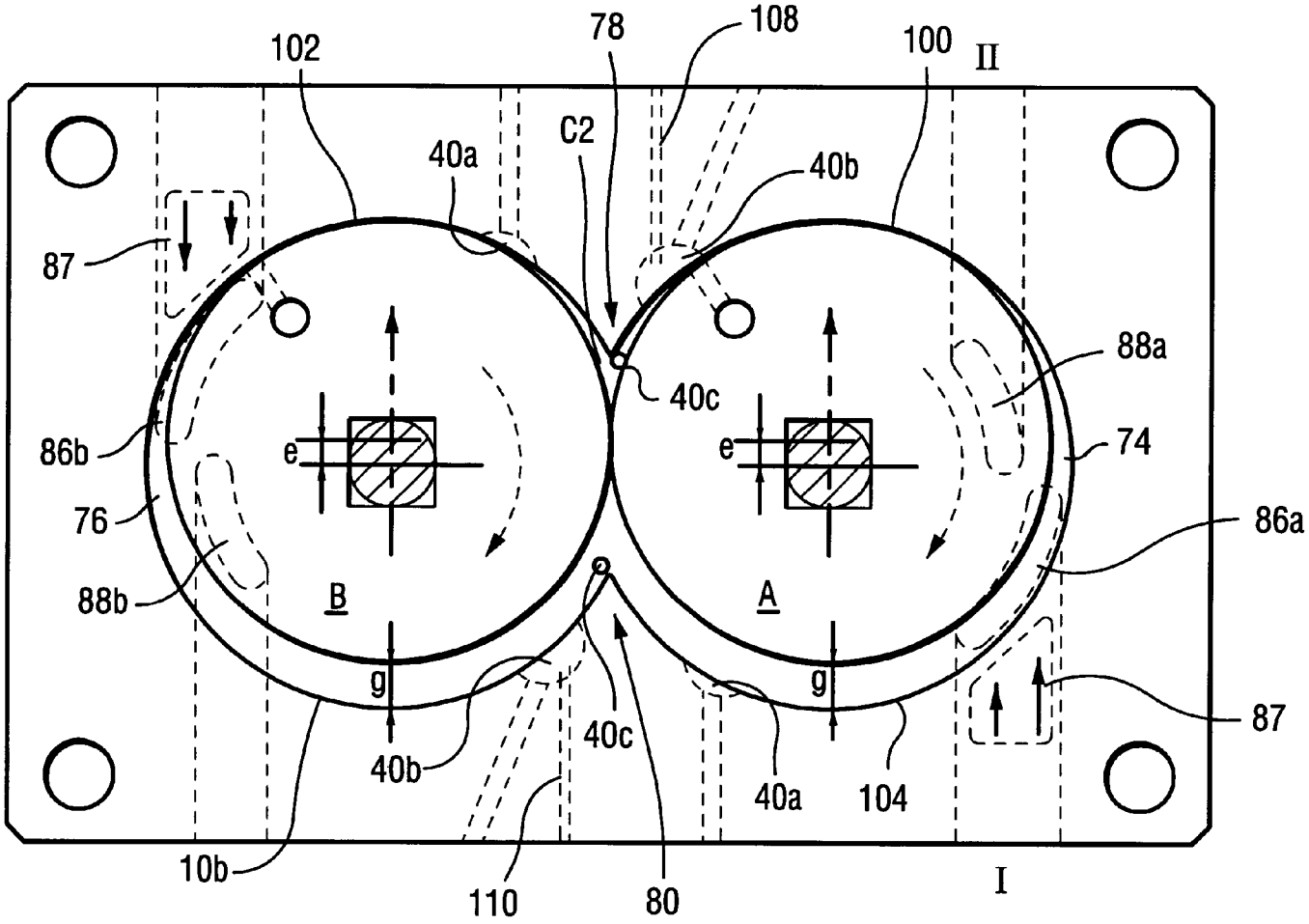
FIGS. 7A–7G are schematic cross-sectional views of the machine of FIG. 1, also taken along line 5A therein, showing the different positions of the rotors during different stages of operation.

For the sake of simplicity, the angular disposition of the rotors is indicated in FIGS. 7A–7G by arrowheads aa and bb, respectively, wherein an initial position is indicated in FIG. 7A by virtue of the arrowheads pointing perpendicularly towards a side of the housing indicated as side II. Progress of the rotors through their work cycles is indicated in FIGS. 7B–7G by successive angular displacements of the arrowheads relative to the their initial positions.

In accordance with a preferred embodiment of the invention, rotors A and B are illustrated with equal diameters, and bores 74 and 76 therefore, similarly, have equal diameters.

Figure 11:
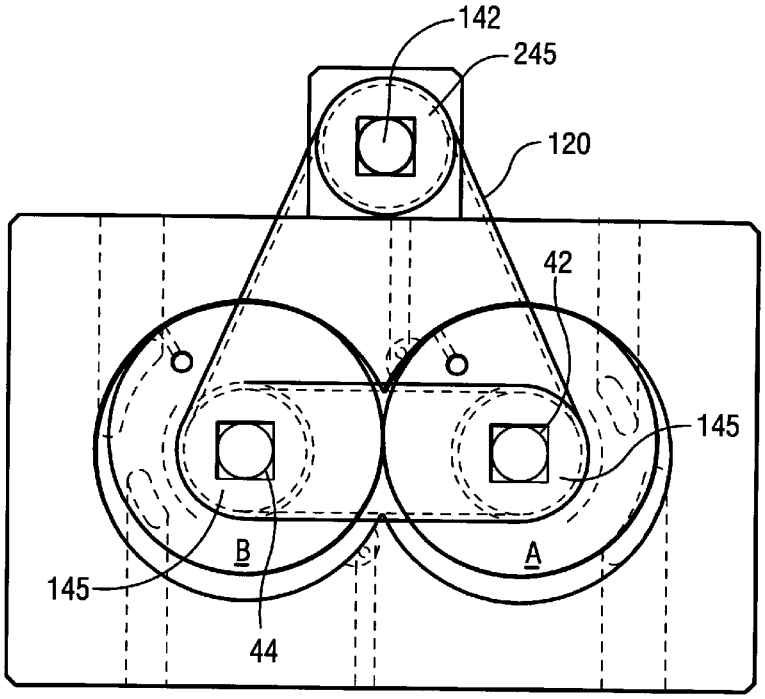
FIG. 11 is a cross-sectional view of the machine of FIG. 1, generally similar to FIG. 7A, but employing a belted synchronization mechanism, in accordance with further embodiments of the invention.
Figure 12:
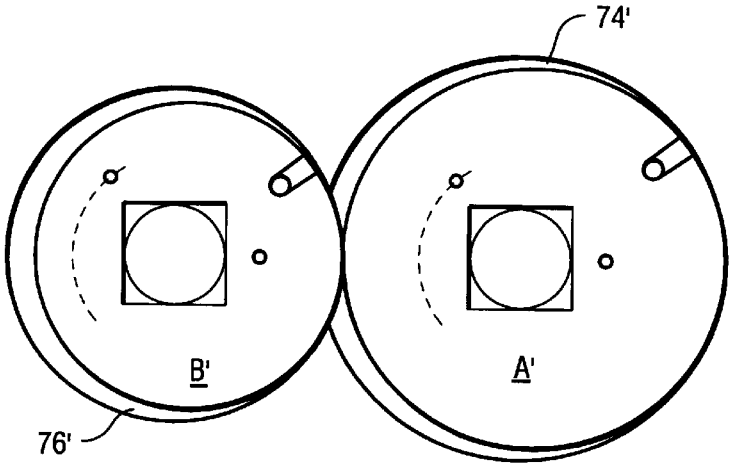
FIG. 12 is a schematic view of a machine constructed in accordance with a further embodiment of the invention, in which the machine is constructed as an ICE having rotors of different sizes.

Referring briefly to FIG. 12, however, it is seen that the present invention may be formed with rotors A' and B', arranged for rotation within respective bores 74' and 76', wherein the respective diameters of the rotors are different, and the respective diameters of the bores, are also different. For purposes of illustration, however, FIGS. 1–11 of the present invention show a case in which rotors A and B and bores 74 and 76 (FIGS. 3, and 7A–7G) have identical diameters.

As seen in FIGS. 1, 5A and 7A, each housing cavity 30*a* and 32*a,* when considered in a direction transverse to axis 60, is generally elongate and is formed, as seen in the drawings, by first and second cylindrical bores, respectively referenced 74 and 76 (FIGS. 5A and 7). As seen in FIGS. 5A and 7A, bores 74 and 76 are separated from each other by non-joining partition walls 78 and 80, illustrated in respective "upper" and "lower" positions.

The terms "upper" and "lower" are intended merely to orientate the reader with regard to the disposition of the described portions as they are depicted in the present drawings, and not to define the orientation of the machine when operated.

As seen in the drawings, rotors A and B are arranged such that they rotate by an eccentricity e equal to half the maximum gap between any portion of the rotors and a curved wall portion, indicated by g in FIG. 7A.

Figure 2:
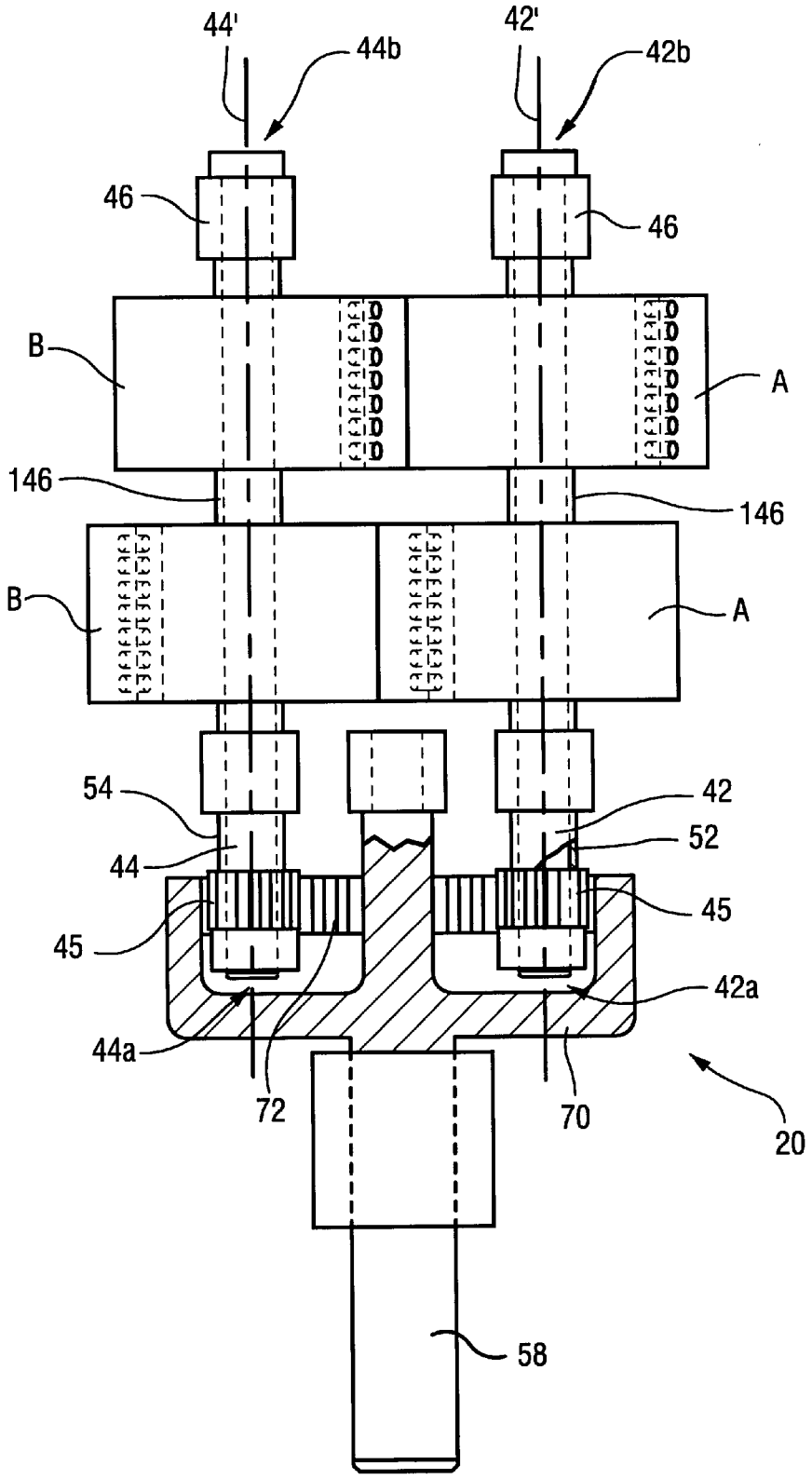
FIG. 2 is a schematic side view of the rotors, transmission and driver of the machine of FIG. 1, in accordance with a preferred embodiment of the invention.
Figure 3:
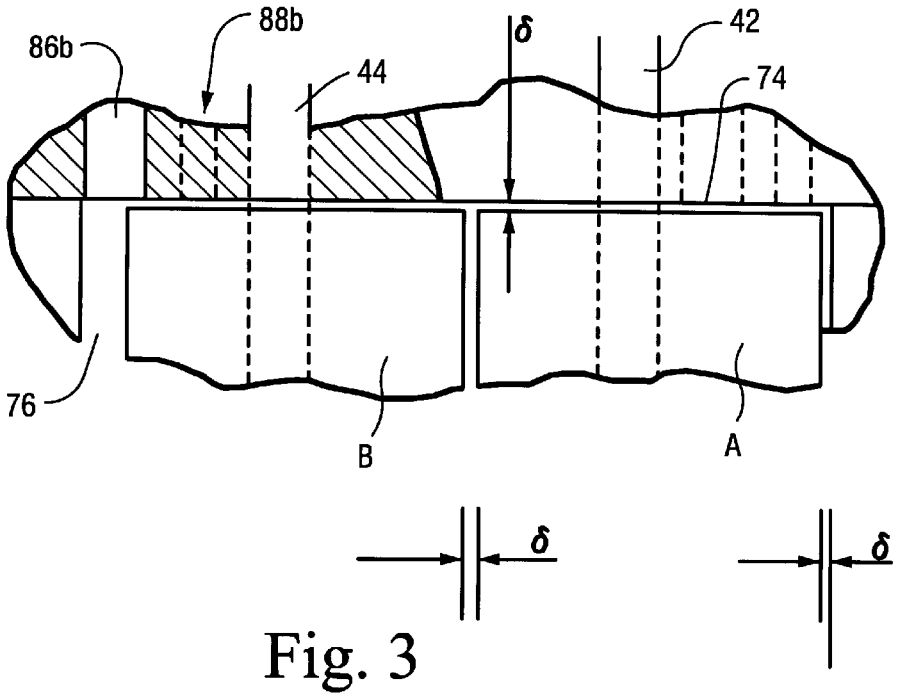
FIG. 3 is an enlarged view showing the non-touching dynamic seals employed in the present invention, indicated generally as portion 3 in FIG. 1.

Referring now particularly to FIGS. 1 and 2, in order to facilitate the above mentioned synchronized motion, the rotors are mounted onto respective rotor shafts 42 and 44, which extend between respective first ends 42*a* and 44*a,* associated with gear assembly 20, and respective second ends 42*b* and 44*b,* which are supported via end bearings 46 in bearing plate 36 (FIG. 1), arranged between manifold and distributor unit 26 and second housing 32. Rotor shafts 42 and 44 define longitudinal axes 42' and 44', (FIG. 2) which are parallel to a longitudinal axis 60 (FIG. 2) of the machine 10. Respective first ends 42*a* and 44*a* of rotor shafts 42 and 44, have mounted thereon spur gears 45, which are arranged for rotation with rotor shafts 42 and 44, and the purpose of which will become apparent from the description hereinbelow.

There is also provided a first pair of spacer bushings 146 which are mounted onto respective shafts 42 and 44, and which are located inside appropriately provided openings in partition 38 (FIG. 1); and a second pair of spacer bushings 52, located in appropriate openings formed in bearing plate 34 (FIG. 1).

An output shaft or driver, referenced 58, extends typically along longitudinal axis 60 of the machine 10, and through an opening 62 (FIG. 1) formed in a main bearing 64, which, in the illustrated arrangement, constitutes an outward extension of gear housing 18. A first, free end 66 of driver 58 may be coupled, as desired, to any external device, as known in the art. A second end 68, located within gear housing 18, has integrally formed therewith a rotary member 70, having formed thereon an inward-facing ring gear 72.

Figure 4:
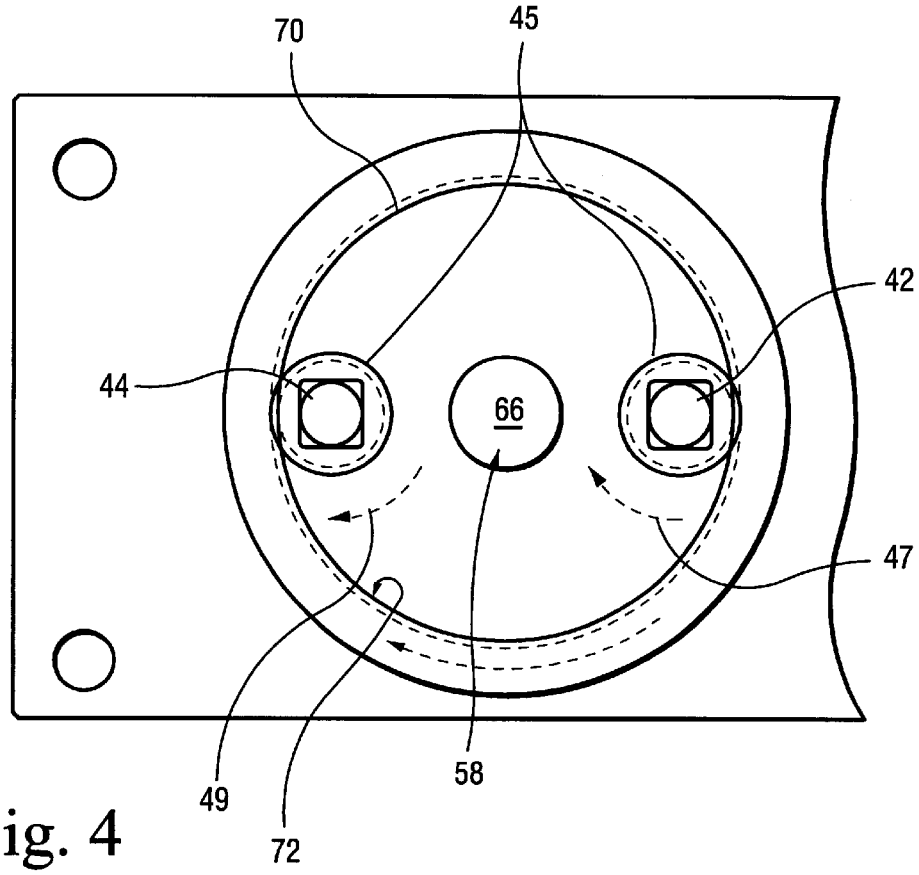
FIG. 4 is a schematic end view of the machine of FIG. 1, taken in the direction of arrow 4 therein.

As seen in FIGS. 1, 2, and 4, spur gears 45 and inward-facing ring gear 72 are positioned so as to be in continuous meshing contact. Accordingly, rotor shafts 42 and 44, and thus also spur gears 45 mounted thereon, rotate in the same directions, as indicated in FIG. 4 by arrows 47 and 49. Rotation of the spur gears 45 is synchronized so as to drive ring gear 72, rotary member 70, and thus also driver 58.

A further benefit of the above-described gear arrangement, is that it enables maintenance of an identical angular disposition of both of rotors A and B in each pair of rotors, as mentioned hereinabove.

The function of the bearings described above is to enable rotation of the shafts and gear assembly components with minimal friction, and so as to prevent any longitudinal movement of the rotors and the shafts relative to the machine body, and appropriate bearings are selected in accordance with this requirement. The bushings are operative to provide exact and unvarying spacing of the rotors, bearings, and spur gears. As the gear assembly 20 and associated bearings must be lubricated, appropriate seals are provided, preventing lubricating fluid from either entering the interior of the rotor housings, or from leaking from any other portion of the machine body.

Referring now briefly to FIG. 11, machine 10 may be modified such that, in place of transmission assembly 20 (FIGS. 1 and 2), there may be provided a toothed drive belt 120, which cooperates with suitable gears 145, thereby to provide the desired synchronization of rotor shafts 42 and 44 and rotors A and B, and so as to maintain the desired corresponding angular orientation thereof.

Preferably, in the present embodiment, the drive belt 120 extends also about a third gear member 245, external to the machine casing, which is drivably associated with a third shaft 142, typically parallel to shafts 42 and 44, and which functions as a power output member or driver. Alternatively, however, the drive belt extends solely about gears 145, in which case one of the rotor shafts 42 and 44 may be extended so as to terminate in a suitable driver or power take off (not shown). An example of a suitable drive belt is the single-sided synchronous polyurethane belt made by Gates GmbH of Eisenbahnweg 50, D-52068, Aachen, Germany.

It is a feature of the present invention that, in order to enable operation of the machine, when used as an ICE, at high temperatures, and maximum power output of the machine, the following conditions are met:

1. the rotors, rotor housings, bearing plates 34 and 36, and partition plate 38, are made of a material having low thermal expansion and good thermal insulation properties,
2. the rotors do not touch any of the stationary surfaces, or each other, and
3. there are no parts in the rotor housings that require lubrication.

It will be appreciated that, construction of the machine in accordance with the above conditions, is facilitated by forming the rotor and rotor housings of a suitable ceramic material, which may be, by way of non-limiting example, silicon nitride or silicon carbide, as mentioned above. The rotors and housings must, of course, also be formed so as to have mechanical strength adequate for their intended use.

The use of a ceramic material is itself facilitated by the fact that none of the moving parts touch, as well as the fact that the rotors and bores are completely cylindrical, parallel, and normal to rotation axes 42' and 44'. Each rotor is also centrifugally balanced, and each rotor, together with its shaft, is also centrifugally balanced, bearing in mind that one or more additional rotors may be on the same shaft, as in the example of FIGS. 1–8B. Furthermore, each portion of body 12, including gear housing 18, rotor housings 30 and 32, as well as the various sealing and bearing plates therebetween, is precision formed so as to be substantially parallel throughout. The bores via which the shafts extend through the rotors are also perpendicular to the rotor surfaces contiguous therewith. The rotors and shafts are mounted together so as to be tight fitting, and so as to prevent any relative rotation therebetween. Accordingly, by way of non-limiting example only, the shafts are illustrated as having a square cross-section. It will be appreciated that other cross-sectional shapes may also be employed, although it is imperative that only those shapes or locking arrangements maintaining a centrifugal balance, be used. The shaft is also precision formed.

It will be appreciated that the tolerances between the various machine portions can be reduced in accordance with the accuracy of their manufacture, and this, in turn, improves the performance of the machine.

The use of ceramics for construction of the rotors, rotor housings 30 and 32, bearing plates 34 and 36, and partition plate 38, enables high operating temperatures to be sustained, thereby providing a large temperature difference between the interior and exterior of the engine, so as to maximize its efficiency, in accordance with the well known Carnot Law. The absence of lubrication in the combustion chambers also leads to a reduction in emissions caused by burning of lubricating fluids.

It will be appreciated by persons skilled in the art that, as opposed to reciprocating engines in which the combustion cavities have a low ratio of surface area to volume, in the present invention, in which the combustion cavities have a high ratio of surface area to volume, if either the rotors or the rotor housings were to be made from a heat conductive material, such as metal, there would be a very large and rapid loss of thermal energy, and the present invention would not be able to function as an internal combustion engine.

It is an important feature of the invention that, in order to maximize machine performance, frictional loss is reduced to a minimum. Accordingly, while rotors A and B may appear to be touching in certain positions, and the rotors may also appear to be touching inner surfaces of the rotor housings, as seen in the magnified view of FIG. 3, rotors A and B are never in touching contact with any portion of the housings or each other. The clearance $\delta$ between the rotors and themselves and between the rotors and stationary surfaces is preferably in the range 0.03–0.08 millimeter. Accordingly, it is to be expected that, during operation of the machine, there is developed a high linear speed at the periphery of the rotors, providing insufficient time for any significant leakage to occur between either the rotors, or between the rotors and the stationary surfaces. By way of example, when the diameter of the rotors is 160 millimeters, the rotational speed may be, by way of non-limiting example only, about 20,000 rpm, giving a linear speed of 160 m/s. The functional relationship between the rotors A and B and between the rotors and stationary surfaces, is thus referred to herein as "dynamic, non-touching sealing."

Each rotor A and B in each pair or rotors, is mounted, as seen clearly in FIGS. 1 and 2, for eccentric rotation about rotation axes 42' and 44'.

Referring now once again briefly to FIG. 5A, housing 32 is seen in elevational view, without rotors A and B. It will of course be appreciated that housings 30 and 32 are substantially the same, but that they are preferably oppositely positioned within machine 10, so as to enable a desired alternating intake of air at each side of the machine, and a corresponding alternating exhausting of exhaust gases, therefrom. This alternate positioning provides a corresponding alternating power cycle, which provides for a balanced operation of the machine.

It should be noted that, for the sake of brevity, housing 32 only is described herein in detail, and that housing 30 has a substantially identical construction thereto.

As seen in FIG. 5A, bores 74 and 76 have respective side walls 82 and 84, in which are formed air inlet ports 86*a* and 86*b*, and exhaust ports 88. Inlet ports 86*a* and 86*b* are situated at an exterior portion of bores 74 and 76, so as to be periodically uncovered during the power cycle of the machine, as described below, due to the eccentric rotation of rotors A and B on bores 74 and 76. Exhaust ports 88 are positioned so as to be covered at all times by rotors A and B, flushing of exhaust gases therethrough being enabled periodically during rotation of rotors A and B. The positions of respective inlet ports 86*a* and 86*b* relative to respective axes 42' and 44' are indicated by radii denoted R1, while the positions of respective exhaust ports 88, which are situated more inwardly thereof, are indicated by radii denoted R2. In order to prevent a loss of pressure during a compression portion of the operating cycle of the machine, each inlet port 86*a*, 86*b* is further preferably provided with a suitable one-way flow device, depicted at 87. Any suitable device may be used for this purpose, including, by way of non-limiting example, a reed valve.

High pressures are developed within housings 30 and 32 during the filling stage due to the large volume of air required to be taken in, during a very short period of time. Accordingly, the air intake is preferably assisted by means of an external pressure source, such as a turbo mechanism or the like. This is shown and described below, by way of illustrative example, in FIG. 15.

Figure 7D:
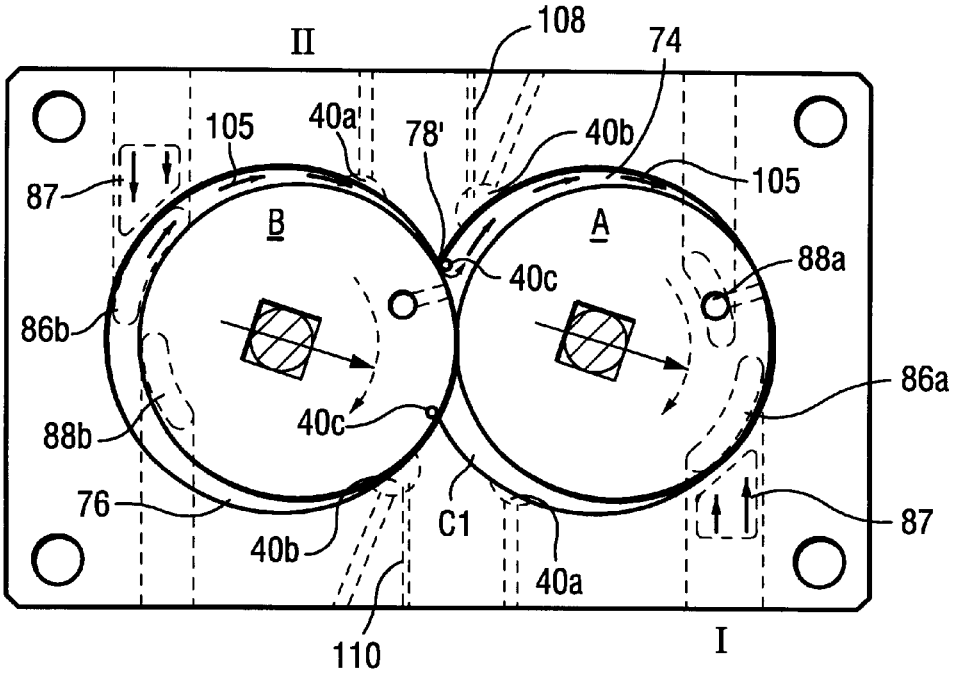
Figure 8B:
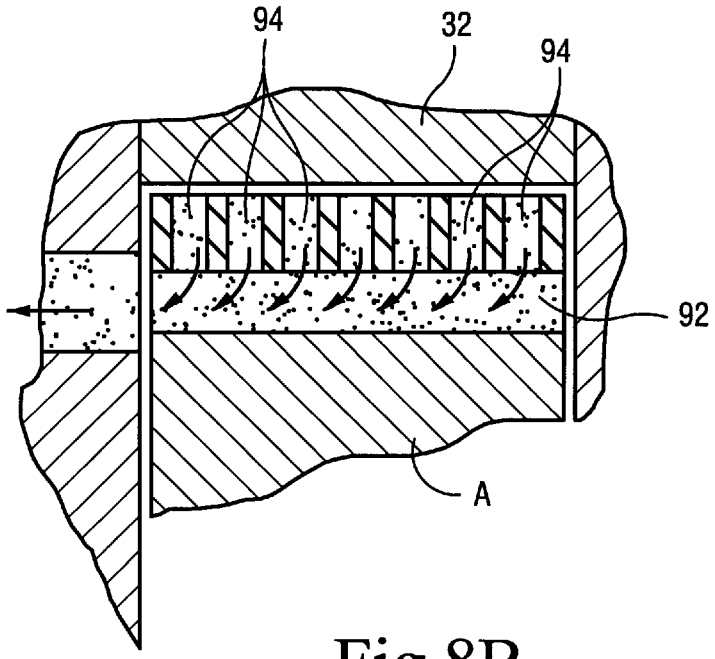
FIG. 8B is an enlarged schematic cross-sectional view of an exhaust portion of a rotor, during exhaustion therefrom of collected exhaust gases, as seen in FIG. 7D, and taken along line 8B—8B therein.
Figure 8A:
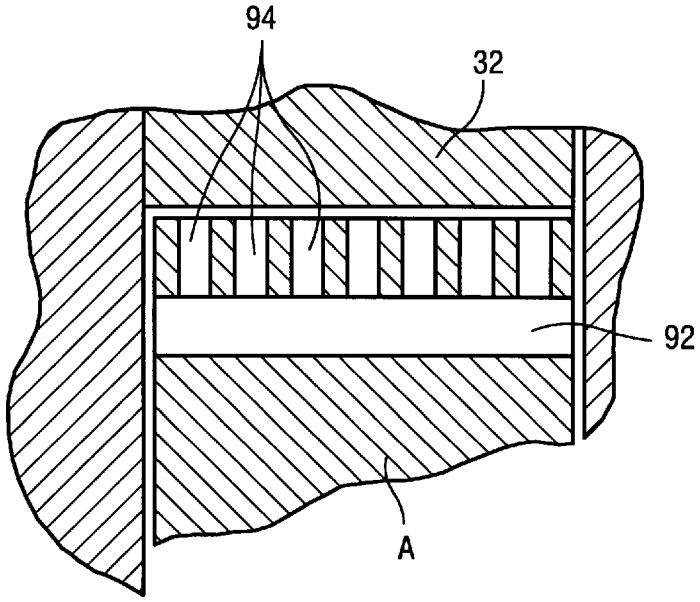
FIG. 8A is an enlarged schematic cross-sectional view of an exhaust portion of a rotor, during initial collection therein of exhaust gases, as seen in FIG. 7C, and taken along line 8A—8A therein.

Referring now briefly FIGS. 8A and 8B, each rotor is provided with an exhaust bore 92, and a plurality of generally radially aligned exhaust inlet bores 94 connected thereto. During rotation of the rotors, bore 92 is periodically brought into registration with exhaust ports 88*a* and 88*b*, thereby permit flushing of exhaust gases from the interior of the machine, as described below in more detail, in conjunction with FIGS. 7D and 8B.

Figure 7B:
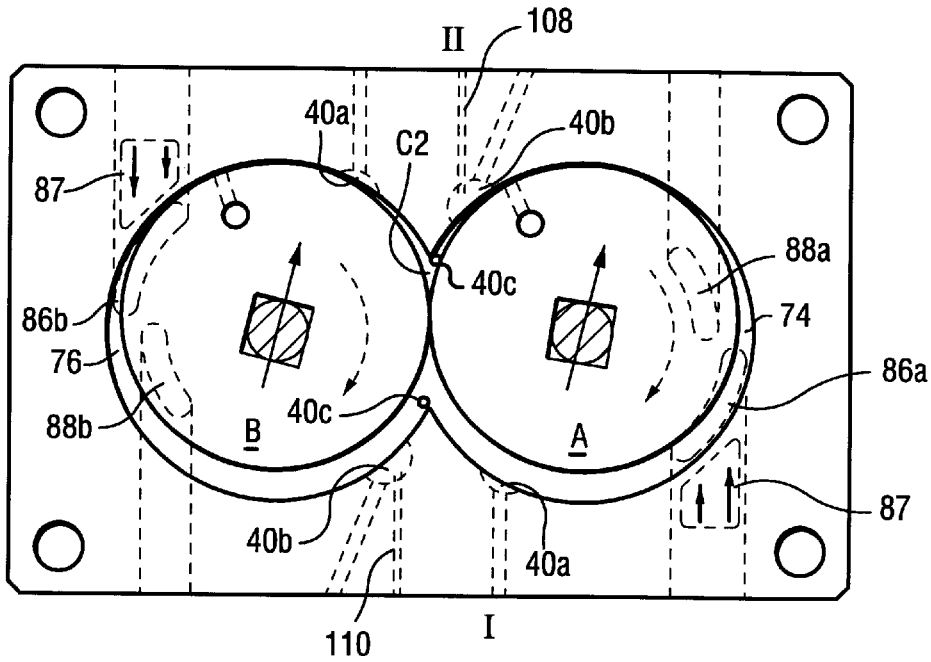
Figure 7C:
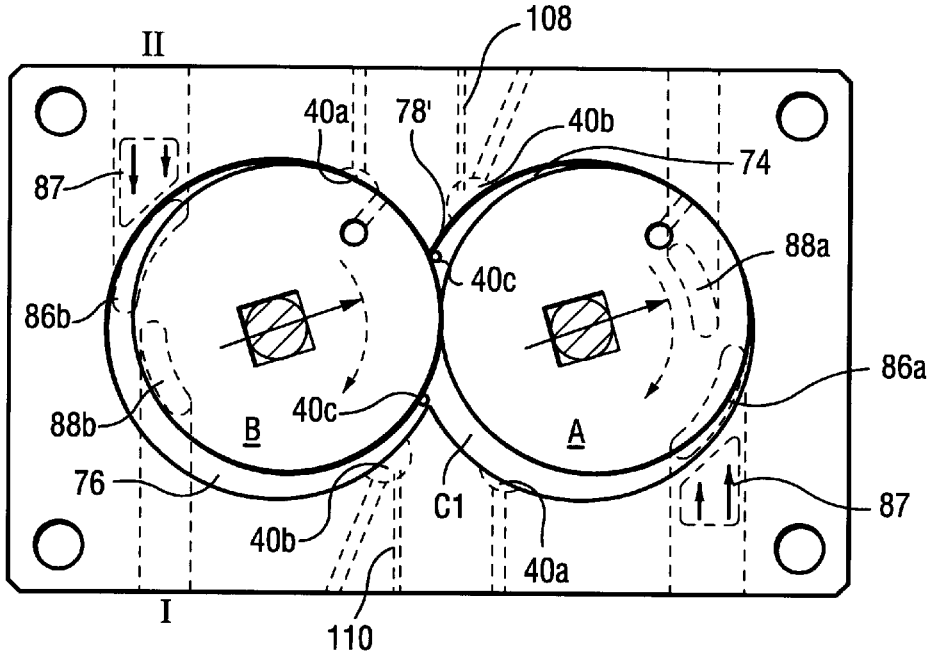
Figure 7E:
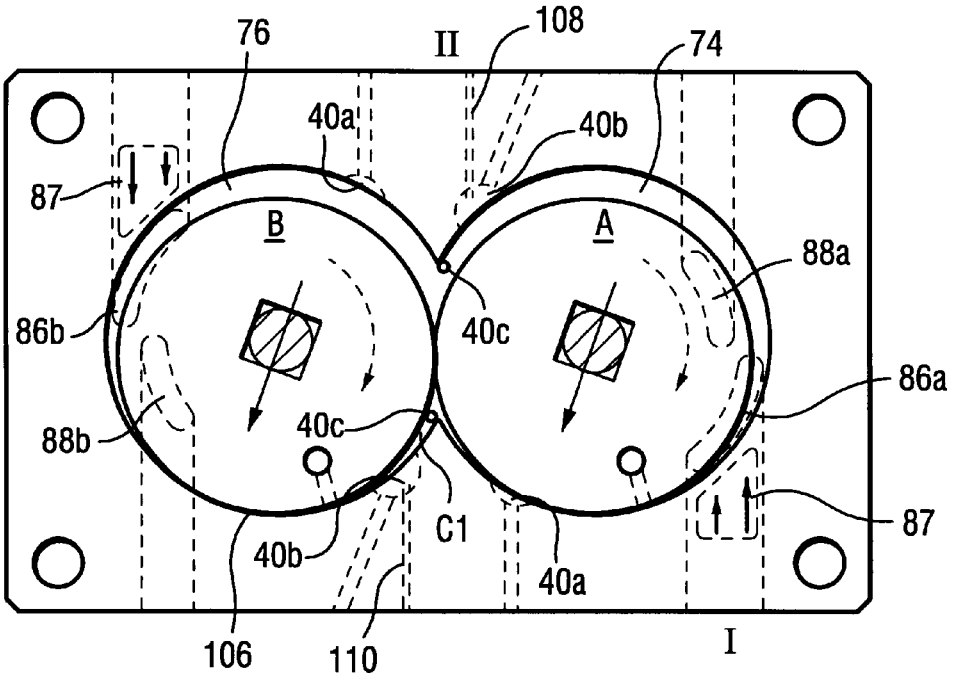

Referring briefly to FIGS. 7A–7G, the rotors and cavities of machine 10, when constructed as an ICE, are formed so as to provide for combustion to occur alternately in a first combustion chamber C1, and in a second combustion chamber C2. First combustion chamber C1 is seen in FIGS. 7B and 7C, and is formed momentarily between the rotors and an upper side II of the rotor housing. Second combustion chamber C2 is seen in FIG. 7E, and is formed momentarily between the rotors and a lower side I of the rotor housing.

There are also provided upper and lower electrode pairs, respectively referenced 108 and 110. Upper electrode pair 108 is required for ignition of the fuel-air mixture in upper combustion chamber C1 (FIGS. 7B and 7C), and lower electrode pair 110 is required for ignition of a fuel-air mixture in lower combustion chamber C2 (FIG. 7E). Preferably, operation of the electrode pairs is required only during initial stages of operation of the engine, after which ignition occurs due to the elevated temperature at those surface portions of the machine cavity and of the rotors which are repeatedly exposed to combustion. Alternatively, however, the electrode pairs may be operated throughout operation of the engine, if required.

Prior to the description below of a complete working cycle of the machine 10 as an ICE, operation thereof with regard to a combustion force generated, is described, in conjunction with FIGS. 6A and 6B.

Figure 6A:
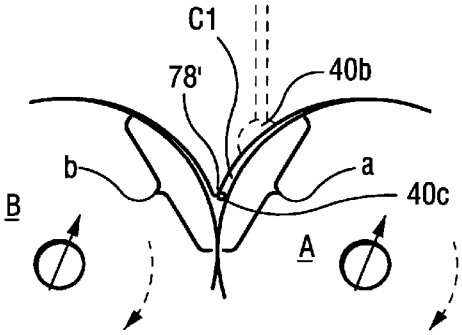
FIGS. 6A and 6B are schematic views of extreme stages of a combustion chamber during a working cycle of the invention, when employed as an internal combustion engine.
Figure 6B:
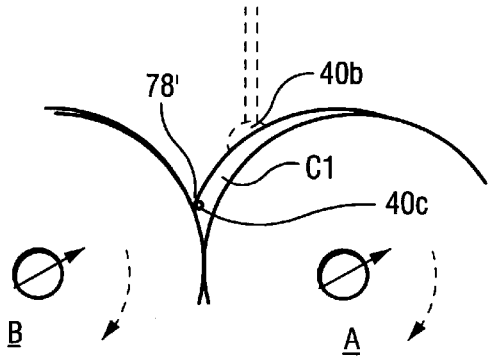

FIG. 6A is an view of combustion chamber C1, immediately after termination of compression of a volume of air therein and, in the case of use of a diesel-type liquid fuel, at the moment of injection of the fuel into the combustion chamber. The fuel is injected from either or both of fuel inlet locations 40*b* and 40*c*. Immediately following injection, there occurs ignition of the resulting fuel-air mixture confined in the combustion chamber.

In the case of use of a gasoline-type liquid fuel, injection occurs closer to the start of compression, via more upstream location 40*a* (FIG. 5A), and is thus not seen in the present drawing.

At this time, expansion of the combustion gases resulting from the ignition has just started, and the combustion chamber is bounded by portions of non-joining wall 78, as well as a relatively long portion a of rotor A, and a relatively short portion b of rotor B. For the duration of combustion in combustion chamber C1, rotor A is defined as the leading rotor, while rotor B is defined as the trailing rotor. As long as expansion of the combustion gases continues, there is a net rotational force applied to leading rotor A, causing rotation in a direction illustrated in FIG. 6A as clockwise, thus also causing an equal rotation of trailing rotor B, via gear assembly 20 (FIGS. 1 and 2).

As rotors A and B continue to rotate, the combustion gases expand and combustion chamber C1 also increases in size accordingly.

This continues substantially until leading rotor A passes the position seen in FIG. 7C and, as described below in conjunction with FIG. 7D, trailing rotor B passes beyond the illustrated position of dynamic non-touching sealing contact with the apex 78' of partition 78, thereby to admit air into the chamber and to permit flushing thereof. Until this point is reached, and for the duration of the expansion of the combustion gases, leading rotor A undergoes a clockwise rotation.

The above example relates to the portion of the power cycle in which rotor A is the leading rotor and rotor B is the trailing rotor. In the portion of the power cycle in which combustion chamber C2 is employed, however, rotor B is the leading rotor, and rotor A is the trailing rotor.

DESCRIPTION OF THE POWER CYCLE OF MACHINE 10 AS AN ICE

Figure 7F:
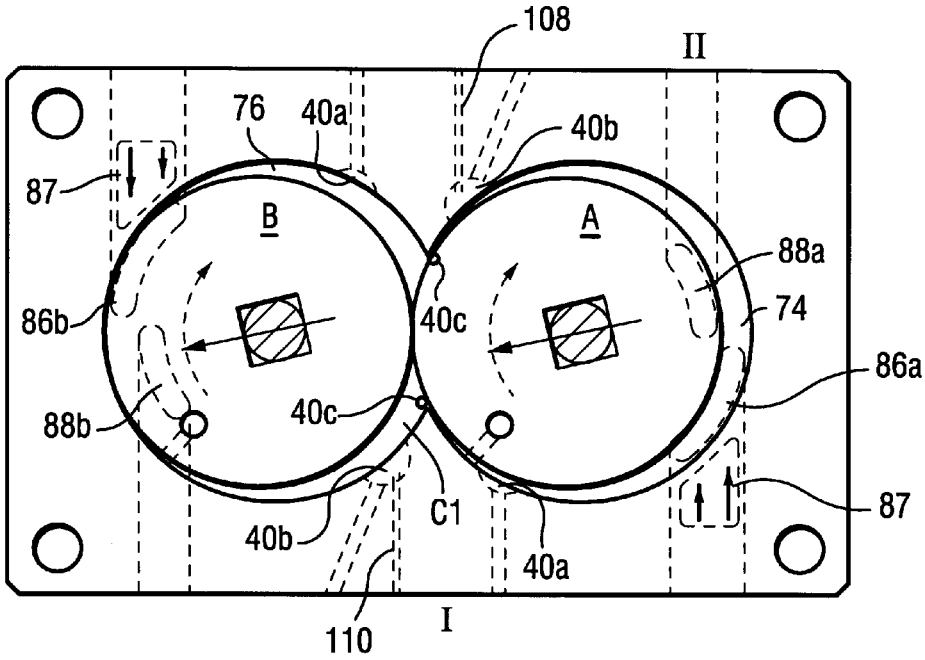
Figure 7G:
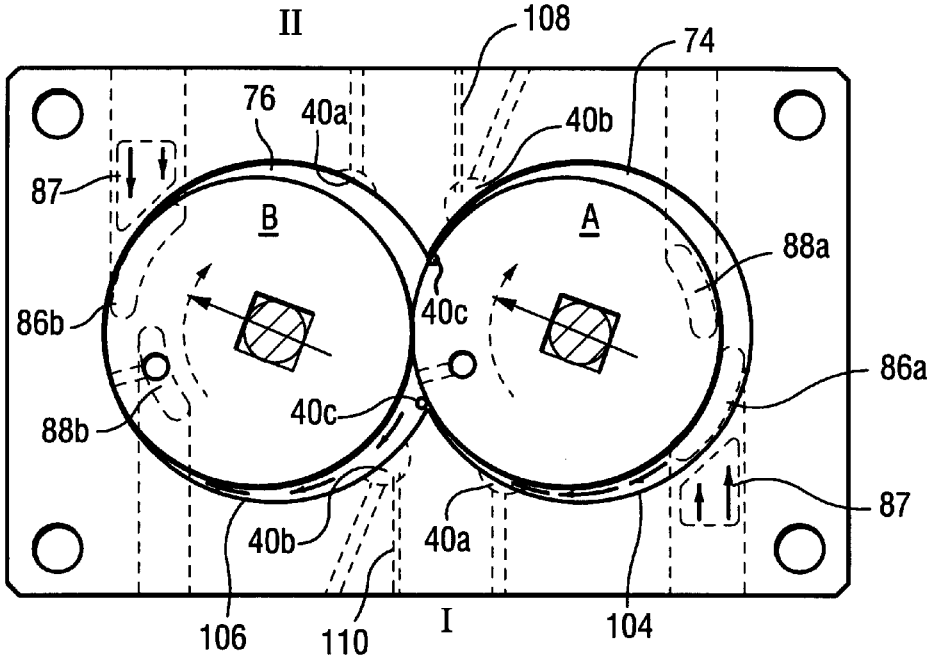

For sake of clarity, the following operating positions are described below in conjunction with FIGS. 7A–8B, relating to a first side which appears as lower side I in the drawings, and to a second side which appears as upper side II in the drawings:

| Drawing | Lower Side I | Upper Side II |
|---|---|---|
| FIG. 7A | Air intake | Compression ends |
| FIG. 7B | Continued Air intake | Fuel injection (DIESEL-TYPE) & combustion in combustion chamber C1 |
| FIG. 7C | End of air intake | End of expansion - just prior to commencement of exhaust of gases via rotor A |
| FIG. 7D | Start of compression and fuel injection (GASOLINE-TYPE) | Air intake & flushing of waste gases via rotor A |
| FIG. 7E | Fuel injection (DIESEL-TYPE), & combustion in combustion chamber C2 | Continued Air intake |
| FIG. 7F | End of expansion - just prior to commencement of exhaustion of gases via rotor B | End of air intake |
| FIG. 7G | Air intake & flushing of waste gases via rotor B | Start of compression and fuel injection (GASOLINE-TYPE) |

It will be appreciated that the terms "upper", "lower", "raised", and "lowered" are orientations used only to indicate portions or positions as they appear in the drawings, and that these portions or positions do not necessarily take on these orientations in the machine when in use.

Referring now initially to FIG. 7A, it is seen that rotors A and B are depicted in generally "raised" positions, so as to be in dynamic non-touching sealing contact with upper side surfaces 100 and 102 of respective bores 74 and 76. In these positions, rotors A and B are spaced apart maximally from respective lower side surfaces 104 and 106 of bores 74 and 76, whereat rotor A uncovers lower intake port 86*a,* while rotor B almost completely covers upper intake port 86*b*. In these positions, rotors A and B, together with upper non-joining partition wall 78, define an enclosed space in which is compressed a volume of air, and which, as seen in FIG. 7B, becomes combustion chamber C1.

In the event that gasoline-type liquid fuel is being used, the volume of air will in fact be a volume of a compressed air-fuel mixture, due to an injection of fuel via fuel injection location 40*a,* as will be described below in conjunction with FIG. 7G.

At this stage, air is supplied via lower intake port 86*a*.

Referring now to FIG. 7B, it is seen that, in the event that the fuel is a diesel-type fuel, it is supplied to combustion chamber C1, via either or both upper fuel injectors 40*b* or 40*c*.

The fuel-air mixture in combustion chamber C1 is ignited by operation of upper electrode pair 108, causing a rotation of rotors A and B in a clockwise direction, towards the position seen in FIG. 7C, and as described above in detail in conjunction with FIGS. 6A and 6B.

At this stage, upper air intake port 86*b* is partially uncovered by trailing rotor B, thereby to permit an intake of air which is used both for flushing exhaust gases, as described below in conjunction with FIG. 7D, and as the air component in upper combustion chamber C1, during the next power cycle.

Referring now also to FIG. 8A, while the high pressure combustion gases enter into exhaust bore 92 of rotor A via the smaller diameter exhaust inlet bores 94, they are not exhausted through exhaust port 88*a* (FIG. 7C), until bore 92 is brought into registration therewith, depicted in FIG. 7D and 8B.

Referring now to FIG. 7D, rotor A has rotated to a position whereat it completely covers lower air inlet port 86*a,* but wherein exhaust bore 92 is in registration with upper exhaust outlet 88*a,* shown also in FIG. 8B. In the event that gasoline-type liquid fuel is being used, it is now injected via lower fuel injection location 40*a,* thereby resulting in an air-fuel mixture.

Rotor B, having rotated through an angular displacement identical to that of rotor A so as to have uncovered upper air inlet port 86*b,* is no longer in dynamic non-touching sealing contact with apex 78' of upper partition 78, such that a gas flow path is provided so as to extend from upper air inlet port 86*b,* along the upper side surfaces 102 and 100 of respective bores 76 and 74, as indicated by arrows 105, exhaust inlet bores 94, bore 92, and upper exhaust outlet port 88*a*. The provision of this flow path causes all the hot waste gases to be flushed out of the cavity, and these may then be released into the atmosphere as via exhaust outlet port 31 (FIG. 1). Alternatively, however, due to the residual heat energy and pressure of the waste gases, they may be usefully recycled.

Referring now to FIG. 7E, in the event that a diesel-type fuel is used, it is supplied to lower combustion chamber C2, via either or both lower fuel injectors 40*b* or 40*c*.

The fuel-air mixture in the combustion chamber C2 is ignited by operation of lower electrode pair 110, causing a rotation of rotors A and B in a clockwise direction, towards the position seen in FIG. 7F, and as described above in detail in conjunction with FIGS. 6A and 6B.

At this stage, lower air intake port 86*a* is partially uncovered by trailing rotor A, thereby to permit an intake of air which is used both for flushing exhaust gases, and as the air component in lower combustion chamber C2, during the next power cycle.

Referring now to FIG. 7G, leading rotor B has rotated to a position whereat it completely covers upper air inlet port 86*b,* but wherein exhaust bore 92 of rotor B is in registration with upper exhaust outlet 88*a.* Trailing rotor A, having rotated through an angular displacement identical to that of leading rotor B so as to have uncovered lower air inlet port 86*a,* is no longer in dynamic non-touching sealing contact with apex 80' of lower partition 80, such that a gas flow path is provided so as to extend from upper air inlet port 86*b,* along the lower side surfaces 104 and 106 of respective bores 74 and 76, as indicated by arrows 107, exhaust inlet bores 94 and bore 92 of rotor B, and lower exhaust outlet port 88*b.* The provision of this flow path causes all the hot waste gases to be flushed out of the cavity, and these may then be released into the atmosphere as via exhaust outlet port 31 (FIG. 1). Alternatively, however, due to the residual heat energy and pressure of the waste gases, they may be usefully recycled.

Further, as mentioned above in conjunction with FIG. 7A, in the event that a gasoline-type fuel is being used, it is now injected via upper fuel injection location 40*a.*

DESCRIPTION OF MACHINE 10 AS A MOTOR

Referring now to FIGS. 9A–10B, machine 10 may, as described above, alternatively be used as a motor. In this case, machine 10 would be driven by an external source of a pressurized working gas.

Figure 10A:
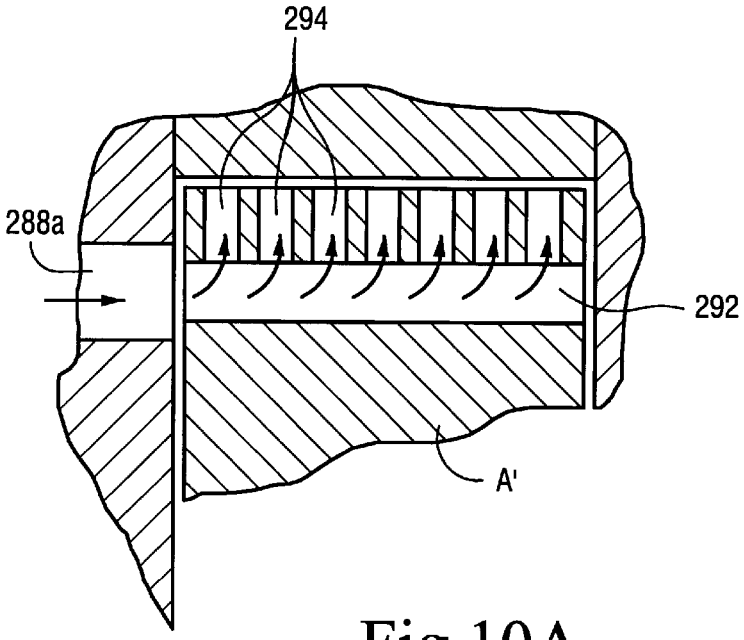
FIG. 10A is an enlarged schematic cross-sectional view of an intake portion of the rotor of FIGS. 9–9E, during supply thereto of a pressurized working gas, as seen in FIG. 9C, and taken along line 10A—10A therein.
Figure 10B:
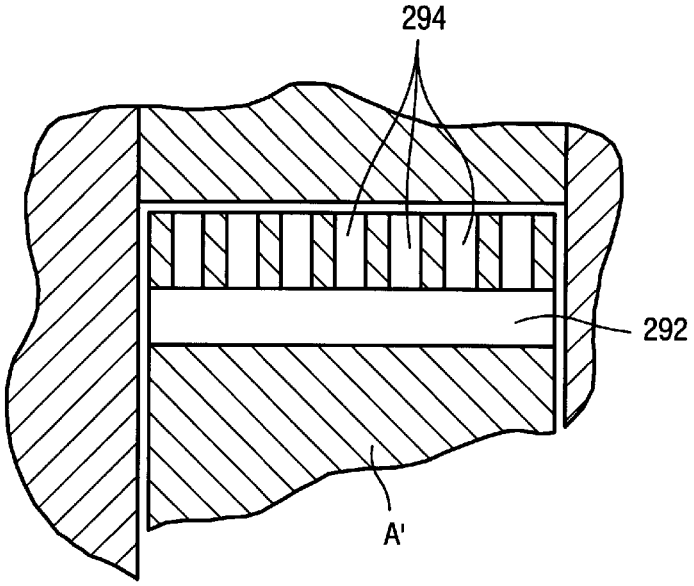
FIG. 10B is an enlarged schematic cross-sectional view of the intake portion seen in FIG. 10A, but during supply of the pressurized working gas to the working cavity of the motor.

In order to employ the external working gas in this way, the operation of machine 10 is reversed, such that the ports used as exhaust ports 88*a* and 88*b* in the embodiment of FIGS. 1–8B become working gas intake ports 288*a* and 288*b* in the present embodiment; and intake ports 86*a* and 86*b* of the embodiment of FIGS. 1–8B, become exhaust ports 286*a* and 286*b* in the present embodiment. Similarly, as seen in FIG. 10A, the pressurized working gas is provided via main bores 292 of the rotors, and is supplied onto the working cavity via inlet bores 294. In order to provide a desired operation, intake ports 288*a* and 288*b* are formed at a first radius from respective axes 42' and 44' so as always to be covered by the rotors A and B, and exhaust ports 286*a* and 286*b* are formed at a second radius from respective axes 42' and 44'—of greater magnitude than the first radius—so as to be periodically covered and uncovered during rotation of rotors A and B.

Figure 9A:
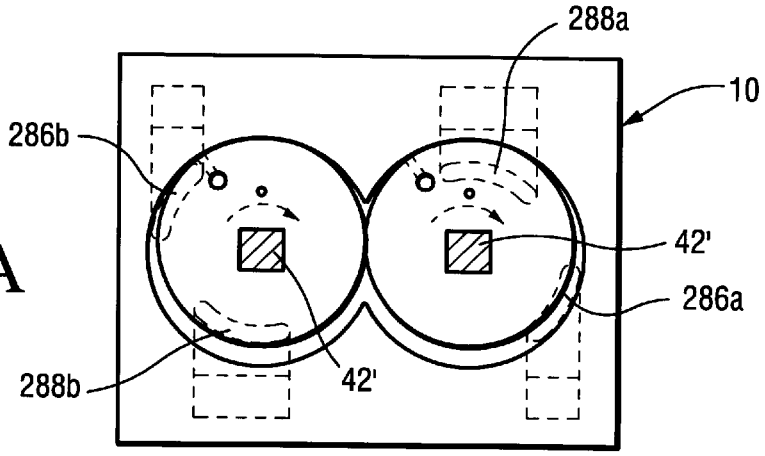
FIGS. 9A–9E are views which correspond generally to those of FIGS. 7A–7G, but wherein the machine of the invention is constructed as a motor, in accordance with an alternative embodiment of the invention.
Figure 9B:
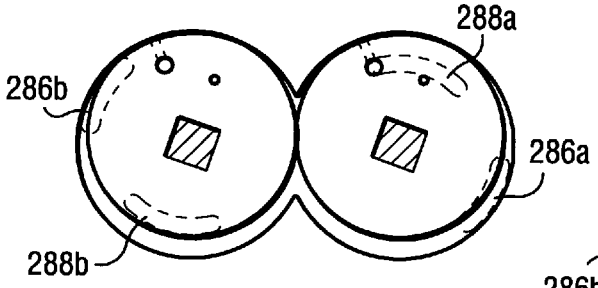
Figure 9C:
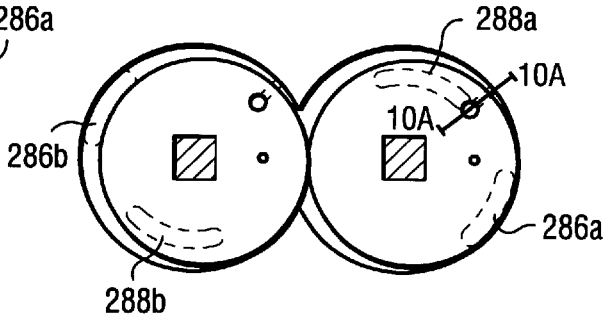
Figure 9D:
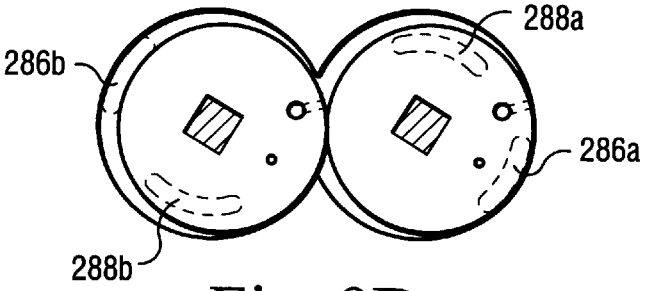
Figure 9E:
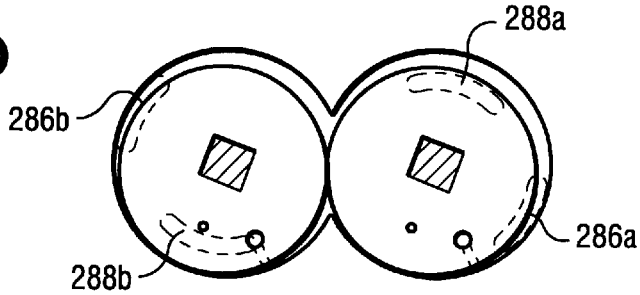

In operation, as the high pressure working gas is supplied to intake ports 288*a* and 288*b,* as, for example, in the position illustrated in FIG. 9B, in which collection bore 292 of leading rotor A is brought into registration with intake port 288*a,* the rotor is rotated by virtue of the pressure applied, and a rotational force is thus produced for the entire period that the collection bore 292 remains in registration with intake port 288*a.* The remainder of the power cycle for this embodiment of the invention is clearly illustrated in the remainder of the sequence of FIGS. 9A–9E, and is thus not described herein, in detail.

DESCRIPTION OF MACHINE 10 AS A COMPRESSOR

Referring now to FIGS. 13A–13F, machine 10 may, as described above, alternatively be used as a compressor. It will be appreciated that the operating cycle of the compressor generally follows that shown and described above in conjunction with FIGS. 7A–7G, in which machine 10 is an ICE. In the present embodiment however, exhaust ports 88*a* and 88*b* are seen to be shorter than those illustrated in FIGS. 5A and 7A–7G, indicating that the compressed air is expelled over a brief, predetermined period, thereby to provide a required burst of compressed air at a desired pressure and timing.

In accordance with one embodiment of the invention, the compressor is incorporated into a machine system, generally as described below in conjunction with FIGS. 14A and 14B, and is used for fuel injection into a single engine housing. Alternatively, however, the compressor may be used as a stand alone machine, and is thus provided with appropriate exit valving (not shown) so as to enable accumulation of a gas under pressure, as known in the art.

Figure 13A:
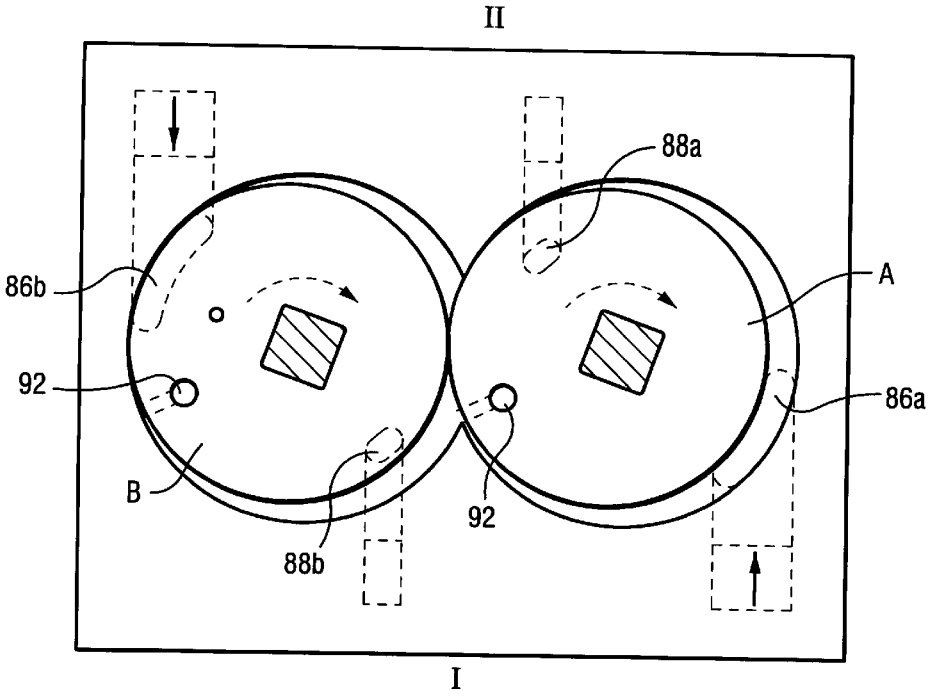
FIGS. 13A–13F are schematic cross-sectional views of the machine of FIG. 1, generally similar to the views of FIGS. 7A–7G and 9A–9E, showing the different positions of the rotors during different stages of operation, but wherein the machine is constructed as a compressor, in accordance with an alternative embodiment of the invention.
Figure 13B:
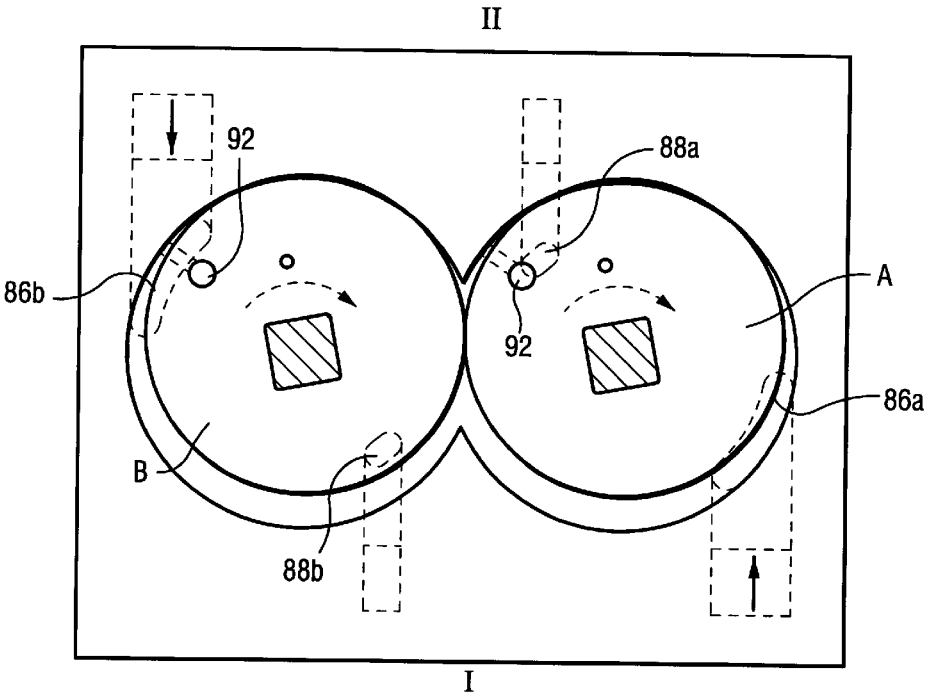
Figure 13C:
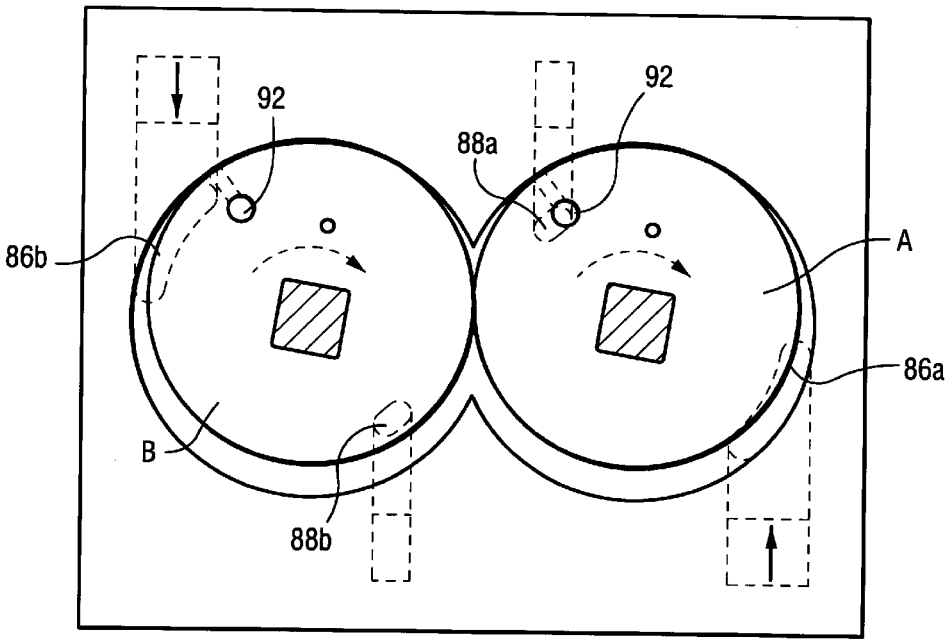
Figure 13D:
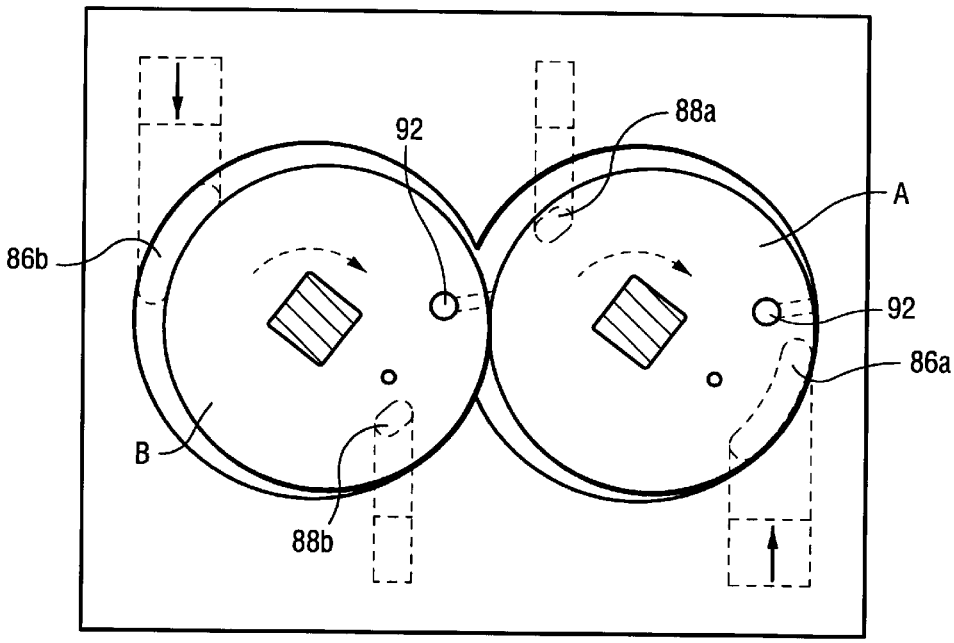
Figure 13E:
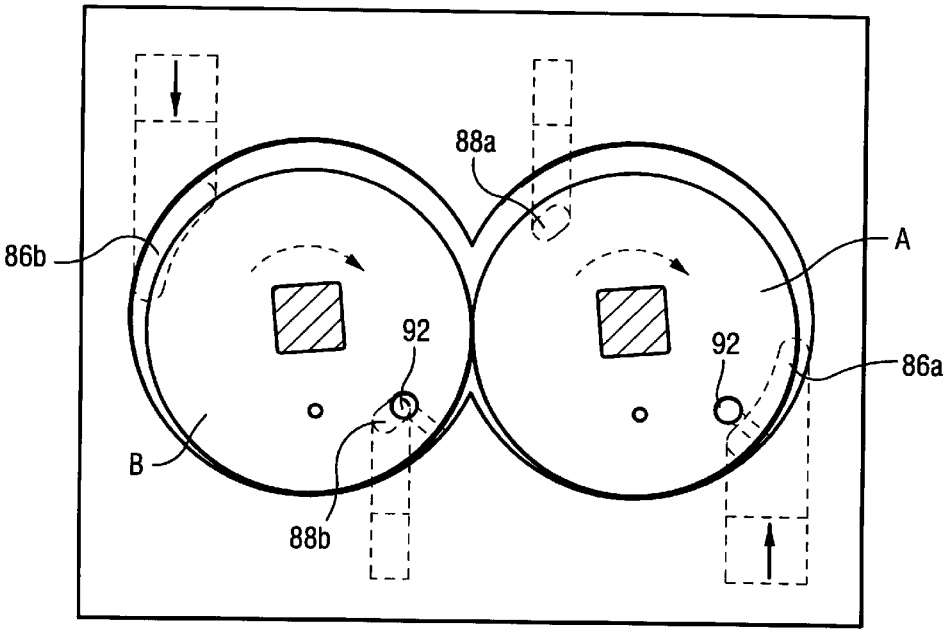
Figure 13F:
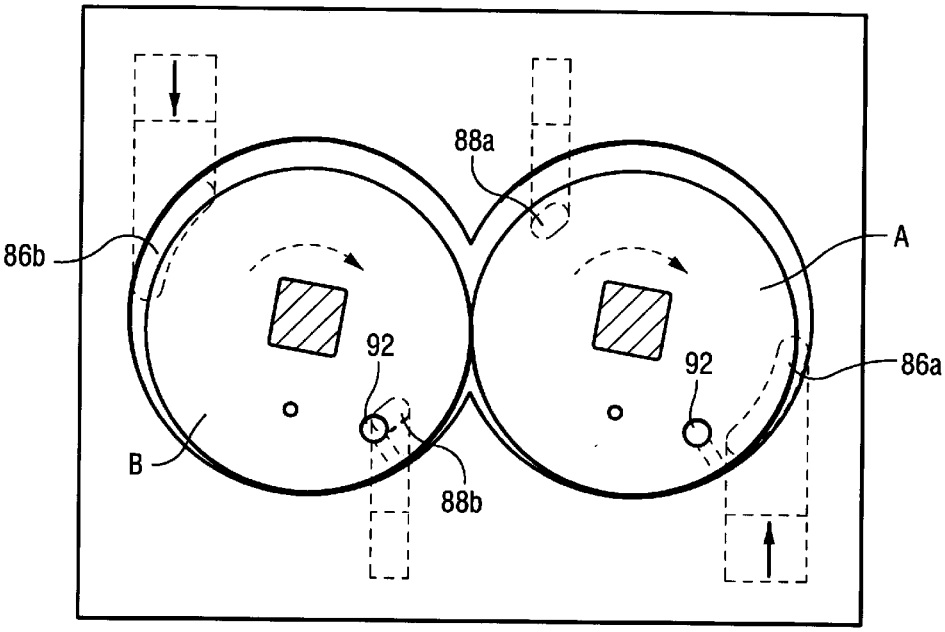

In brief, the power cycle for this embodiment of the invention is shown in the sequence of FIGS. 13A–13F, and is outlined in the following table:

| Drawing | Lower Side I | Upper Side II |
|---|---|---|
| FIG. 13A | Air intake | Start compression |
| FIG. 13B | Continued Air intake | Compression near maximum, start output of compressed air burst |
| FIG. 13C | Continued Air intake | End of compression, finish output of compressed air burst |
| FIG. 13D | Start compression | Air intake |
| FIG. 13E | Compression near maximum, start output of compressed air burst | Continued Air intake |
| FIG. 13F | End of compression, finish output of compressed air burst | Continued Air intake |

Figure 14A:
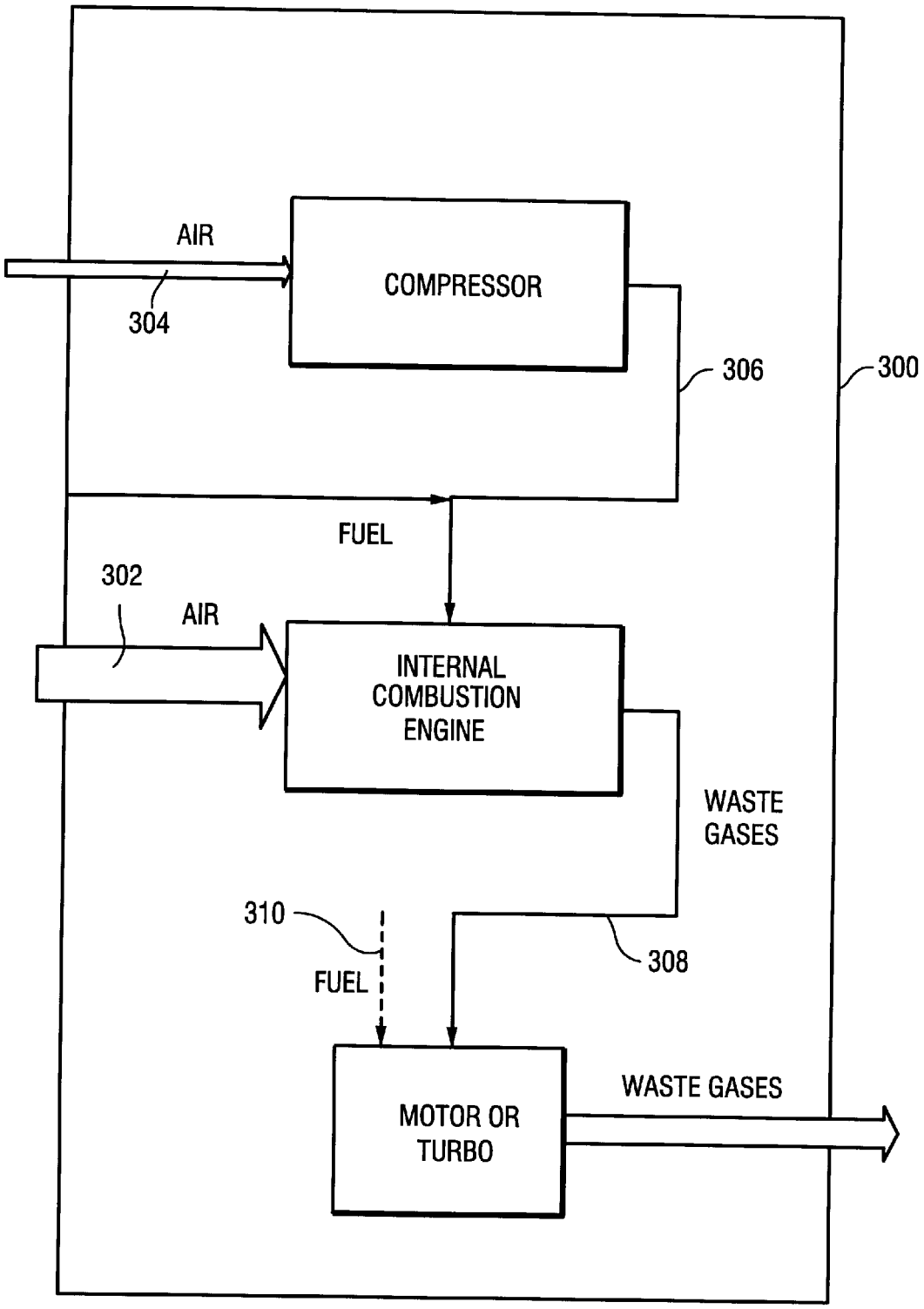
FIG. 14A is a block diagram illustration of a machine constructed in accordance with yet a further embodiment of the invention, in which the compressor and motor of the invention are combined with the internal combustion engine of the invention.
Figure 14B:
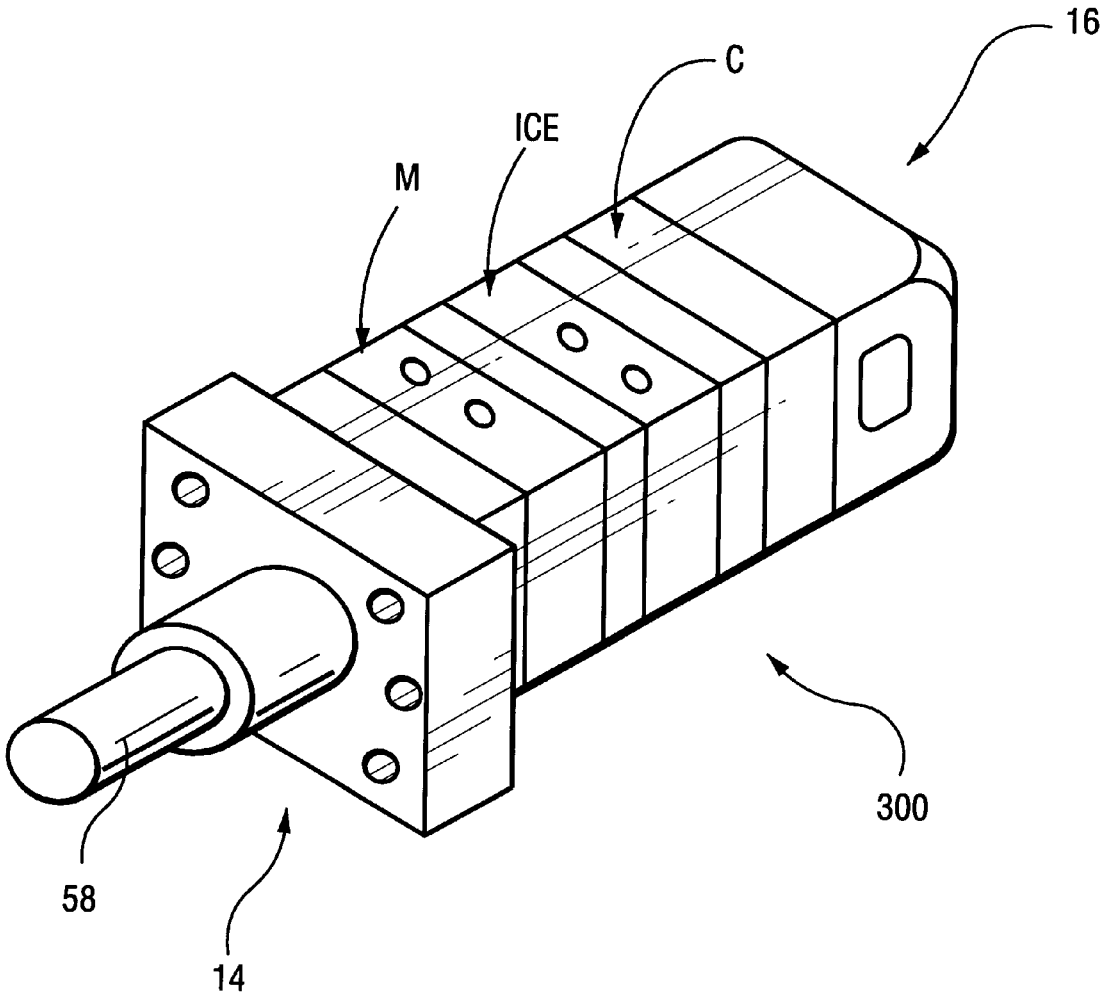
FIG. 14B is a schematic perspective view of the machine seen in FIG. 14A.

Referring now to FIGS. 14A and 14B, there is seen a machine system, referenced generally 300, which includes preferably three machines, namely, an internal combustion engine (ICE), a compressor (C), and a motor (M). Machine system 300 is of overall similar construction to machine 10 as shown and described in conjunction with FIGS. 1–4, except that, rather than being solely an ICE, a motor or a compressor, it preferably combines all three of these machines, preferably mounted onto rotor shafts common to all three machines, into an integrated system. It will be appreciated, however, that, a motor or a compressor only, if preferred, may be combined with the internal combustion engine.

In the present example, however, the illustrated integrated machine system provides its own fuel injection, and also serves to harness heat and pressure contained in the exhaust from the ICE, that might otherwise be wasted, for the benefit of rotation of the rotor shafts and thus of the output of the ICE.

Referring now primarily to FIG. 14A, it is seen that ICE receives a source of air, preferably pressurized, via an intake 302, which communicates via intake ports 86*a* and 86*b* (FIGS. 7A–7G) thereof, with the working cavity of the ICE.

The compressor receives an intake 304 of air via intake ports 86*a* and 86*b* (FIGS. 13A–13F), and expels the air, as shown at 306, so as to provide sharp, pulsed air bursts, which are timed so as to inject fuel from a suitable tank or reservoir (not shown), through any of fuel injection locations 40*a,* 40*b* or 40*c* (FIGS. 5A–7G), so as to facilitate combustion in combustion chambers C1 and C2 (FIGS. 6A–7G).

The ICE expels waste gases via exhaust outlets 88*a* and 88*b* (FIGS. 7A–7G), which, as seen at 308, are provided as a pressure source to the motor, via intake ports 288*a* and 288*b* (FIGS. 9A–9E). Waste gases from the motor are typically expelled into the atmosphere via outlet ports 286*a* and 286*b* (FIGS. 9A–9E).

It will be appreciated that the exhaust gases from the ICE may include some combustible materials that were not burnt in the ICE. Accordingly, in accordance with an alternative embodiment of the invention, and as seen at 310, a certain amount of fuel may be optionally injected into the working cavity of the motor, and may be ignited therein so as to provide a more complete burning of the working gases, and thus reduce pollutant emissions form the engine.

Figure 15:
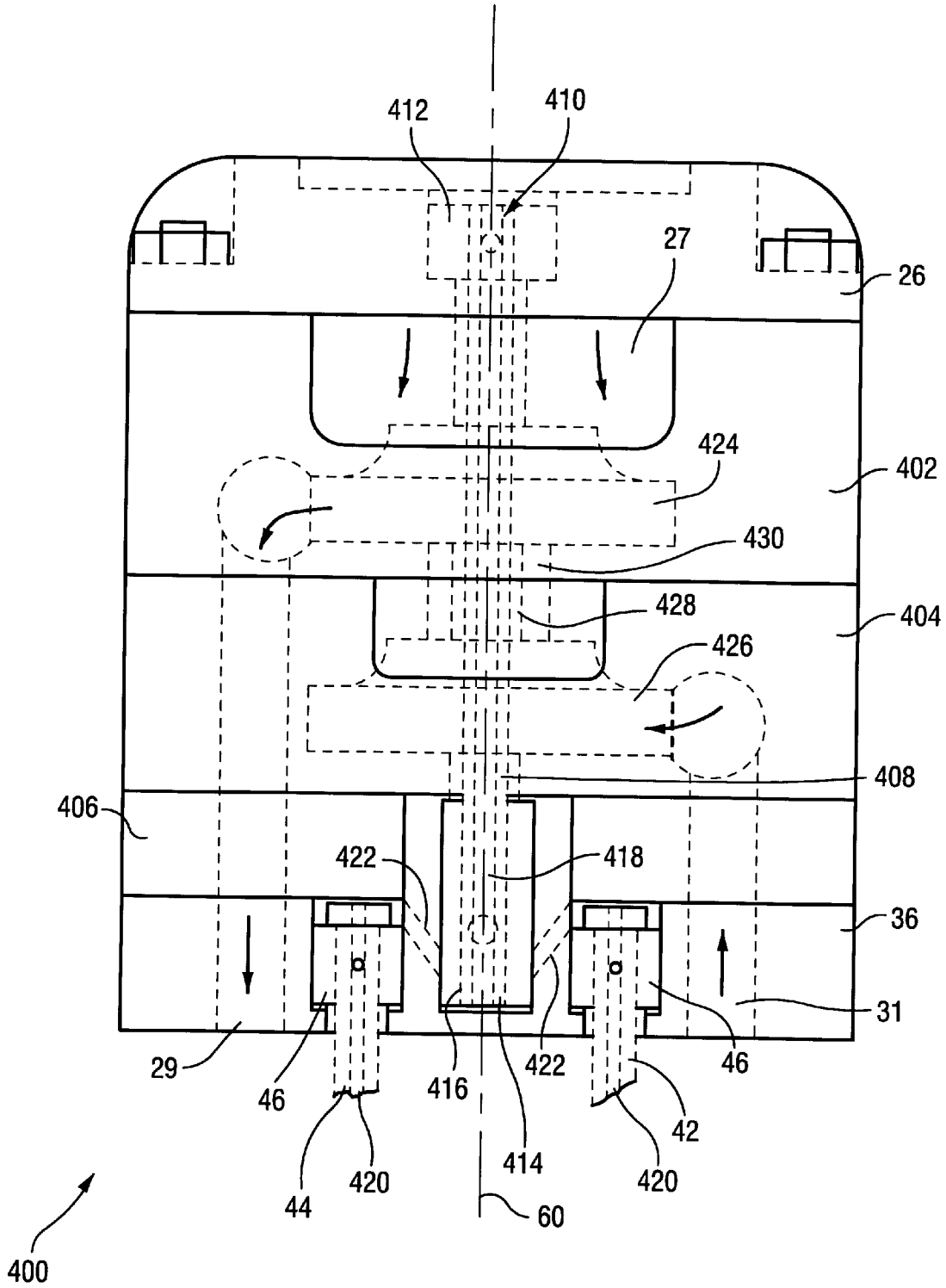
FIG. 15 is a partially cut-away, schematic side view of a rotary machine, similar to that seen in FIG. 1, but including a turbocharger.

Referring now also to FIG. 15, there is seen an end portion of a turbocharged machine, referenced generally 400, which is generally similar to machine 300, except for the fact that the exhaust gases from the ICE are reused in the form of a turbocharger.

It will be appreciated that the turbocharger is facilitated by virtue of the modular construction of the system, wherein each individual machine is encapsulated in a separate housing, thereby also enabling incorporation of the turbocharger. Due to the very high temperatures of the waste gases that are used to drive the turbocharger device, it is preferred that its various components are also formed of ceramic or other equally well insulating materials.

More particularly, there are provided a first impeller housing 402, adjacent to manifold and distributor unit 26, a second impeller housing 404 adjacent to the first impeller housing, and a spacer plate 406, adjacent to bearing plate 36. There is also provided an impeller shaft 408 which extends through and is supported for rotation in manifold and distributor unit 26, first impeller housing 402, second impeller housing 404, spacer plate 406, and bearing plate 36.

Impeller shaft 408 extends along axis 60, and has a first end 410 which is supported via a bearing 412 in manifold and distributor unit 26; and a second end 414, which is supported in bearing plate 36 via a bearing 416, located between end bearings 46. Preferably, a lubricating fluid, which is required for the various gears and bearings only, is provided via a longitudinal bore 418 formed in impeller shaft 408, which communicates with longitudinal bores 420 formed in rotor shafts 42 and 44, via lubrication channels 422 formed in bearing 416.

Impeller shaft 408 has mounted thereon a first impeller 424, which is mounted for rotation with shaft 408 in first impeller housing 402, and aids in the supply of air to the ICE, via inlet conduit 29. Second impeller housing 404 houses a second impeller 426 which is mounted onto shaft 408, for rotation therewith. Impeller shaft 408 is separated from respective first and second impeller housings 402 and 404 by means of a suitable bushing 428, and a suitable heat insulator element 430.

A driving pressure is provided to second impeller 426 typically by way of an exhaust outlet 31 through which pressurized exhaust gases, originating either at the ICE or at the motor, as seen in FIG. 14A, serve to drive second impeller 426, thereby to drive impeller shaft 408, so as to drive first impeller 424, and thereby to intake air through intake 27, for supply, via conduit 29, to the ICE.

It will be appreciated by persons skilled in the art that the scope of the present invention is not limited by what has been shown and described hereinabove. Rather the scope of the present invention is limited solely by the claims, which follow.

What is claimed is:

1. A machine which includes:

a housing having formed therein a generally elongate cavity, said cavity being formed by a pair of adjoining, partially overlapping cylindrical bores, each said bore being separated from an adjoining bore by a pair of non-joining partition walls, and each said bore having a geometric center;

a pair of cylindrical rotors arranged in said pair of adjoining bores, each said rotor being disposed in one of said bores for synchronized, non-touching and same-directional rotation with the other of said pair of rotors about a rotation axis spaced from said geometric center by a predetermined eccentricity, wherein each said cavity is bounded by a pair of parallel wall surfaces transverse to said rotation axis;

at least a pair of gas ports provided in communication with each said bore, for permitting selectable intake and exhaust of working gases, wherein a first of said gas ports is arranged at a first radius from said geometric center and a second of said gas ports is arranged at a second radius from said geometric center, wherein said second radius has a magnitude smaller than that of said first radius, and wherein each said rotor is operative to rotate within one of said bores so as to periodically cover and uncover said first port, thereby to periodically prevent and enable a flow therethrough of a working gas;

a pair of rotor shafts associated with each said pair of cylindrical rotors, each said rotor shaft extending through a single bore of all of said housing cavities, and mounted transversely to each said rotor so as to provide eccentric rotation thereof in said bore; and a gear assembly, and a driver associated with said rotor shafts, said assembly and said driver, cooperating to provide synchronized same directional rotation of said rotor shafts, wherein, introduction of a working gas into interactive association with said rotors causes rotation of said pairs of rotors in said machines and thus also of said driver, and wherein each said rotor has a pair of flat, parallel surfaces disposed in dynamic, non-touching, sealing relation with said pair of parallel wall surfaces of each said cavity, and each said rotor has formed therein a throughflow portion which is formed so as to be brought periodically into communicative association with the interior of said cavity and with said second gas port, so as to facilitate gas communication therebetween.

2. A machine according to claim 1, wherein each said pair of rotors includes first and second rotors, each having a cylindrical outer surface, arranged for rotation within a predetermined pair of adjoining, respective, first and second bores such that said cylindrical outer surfaces of said first and second rotors are always in dynamic, non-touching, sealing relation with each other.

3. A machine according to claim 2, wherein said machine is an internal combustion engine, and said rotors are operative, during said rotation thereof, to cooperate with said partition walls and predetermined portions of said parallel wall surfaces so as to periodically form combustion chambers therewith, and wherein said housing and said rotors are formed of a substantially non-heat conducting material, thereby to enable an elevated temperature to be sustained within said combustion chambers during operation of said engine.

4. A machine according to claim 3, wherein said elevated temperature, once attained during operation of said engine, is sufficient to cause combustion of an air-fuel mixture in said combustion chambers, even when the compression ratio is well below 1:19.

5. A machine according to claim 3, wherein said substantially non-heat conducting material is a ceramic material.

6. A machine according to claim 2, wherein said first port is a working gas intake port, and said second port is a working gas exhaust port, and wherein each said pair of rotors are operative to rotate through a working cycle having first and second portions, wherein, during said first portion of said working cycle, said first and second rotors are operative to rotate into first positions whereat they are initially spaced from a first side of said cavity so as to define a first working space therewith, and said first rotor is operative to uncover said working gas intake port in said first bore thereby to admit air into said space;

said first rotors and second rotors are operative to rotate into second positions so as to reduce the volume of said first working space and thus compress the working gas therein; and said first rotors and second rotors are operative to be rotated into third positions in response to an expansion of the working gas in said first working space, and such that said second rotor is operative to bring said throughflow portion thereof into communicative association with the interior of said cavity and with said exhaust port in a second bore, so as to facilitate exhausting of working gas from said second working space;

and wherein, during said second portion of said working cycle, said first and second rotors are operative to rotate into fourth positions whereat they are initially spaced from a second side of said cavity, opposite said first side of said cavity, so as to define a second working space therewith, and said second rotor is operative to uncover said working gas intake port in said second bore thereby to admit air into said second working space;

said first rotors and second rotors are operative to rotate into fifth positions so as to reduce the volume of said second working space and thus compress the working gas therein; and said first rotors and second rotors are operative to rotate into sixth positions so as to permit expansion of the working gas in said working space, and such that said first rotor is operative to bring said throughflow portion thereof into communicative association with the interior of said cavity and with said exhaust port in said first bore, so as to facilitate exhausting of working gas from said second working space.

7. A machine according to claim 6, wherein, during said first portion of the working cycle, as said first rotors and second rotors rotate into said third positions, said first rotor is operative to uncover said intake port in said first bore, thereby to permit a throughflow between said intake port in said first bore, said first working space, said throughflow portion of said second rotor, and said exhaust port in said second bore;

and wherein, during said second portion of the working cycle, as said first rotors and second rotors rotate into said sixth positions, said second rotor is operative to uncover said intake port in said second bore, thereby to permit a throughflow between said intake port in said second bore, said second working space, said throughflow portion of said first rotor, and said exhaust port in said first bore.

8. A machine according to claim 7, wherein said machine is an internal combustion engine, said first and second working spaces are first and second combustion chambers, said working gas intake ports are air intake ports, and said working gas exhaust ports are combustion gas exhaust ports, and wherein said machine also includes at least first and second fuel injectors for injecting fuel into said first and second combustion chambers so as to provide fuel-air mixtures therein and so also as to enable combustion of the fuel-air mixtures, thereby to provide a rotational force on said second rotor during said first portion of said working cycle, and on said first rotor during said second portion of said working cycle.

9. A machine according to claim 8, and also including ignition apparatus associated with said first and second combustion chambers, for selectably igniting the fuel-air mixtures therein.

10. A machine according to claim 1, wherein said machine is a motor, associable with an external source of pressurized working gas.

11. A machine according to claim 10, wherein each said pair of rotors includes first and second rotors, each having a cylindrical outer surface, arranged for rotation within a predetermined pair of adjoining, respective, first and second bores such that said cylindrical outer surfaces of said first and second rotors are always in dynamic, non-touching, sealing relation with each other.

12. A machine according to claim 11, wherein said first port is a pressurized working gas intake port, and said second port is a working gas exhaust port.

13. A machine according to claim 1, wherein said machine is a compressor, associable with an external source of a working gas.

14. A machine according to claim 13, wherein each said pair of rotors includes first and second rotors, each having a cylindrical outer surface, arranged for rotation within a predetermined pair of adjoining, respective, first and second bores such that said cylindrical outer surfaces of said first and second rotors are always in dynamic, non-touching, sealing relation with each other.

15. A machine according to claim 14, wherein said second port is a working gas intake port, and said first port is a pressurized working gas exhaust port.

16. An integrated machine system including:

a plurality of mutually cooperating machines, each including:

a housing having formed therein a generally elongate cavity, said cavity being formed by a pair of adjoining, partially overlapping cylindrical bores, each said bore being separated from an adjoining bore by a pair of non-joining partition walls, and each said bore having a geometric center;

a pair of cylindrical rotors arranged in said pair of adjoining bores of said housing, each said rotor being disposed in one of said bores for synchronized, non-touching and same-directional rotation with the other of said pair of rotors about a rotation axis spaced from said geometric center by a predetermined eccentricity, wherein each said cavity is bounded by a pair of parallel wall surfaces transverse to said rotation axis;

at least a pair of gas ports provided in communication with each said bore, for permitting selectable intake and exhaust of working gases, wherein a first of said gas ports is arranged at a first radius from said geometric center and a second of said gas ports is arranged at a second radius from said geometric center, wherein said second radius has a magnitude smaller than that of said first radius, and wherein each said rotor is operative to rotate within one of said bores so as to periodically uncover said first port, thereby to enable a flow therethrough of a working gas:

a pair of rotor shafts associated with each said pair of cylindrical rotors, each said rotor shaft extending through a single bore of all of said housing cavities, and mounted transversely to each said rotor so as to provide eccentric rotation thereof in said bore; and a gear assembly, and a driver associated with said rotor shafts, said assembly and said driver, cooperating to provide synchronized same directional rotation of said rotor shafts, wherein, introduction of a working gas into interactive association with said rotors causes rotation of said pairs of rotors in said machines and thus also of said driver, and wherein each said rotor has a pair of flat, parallel surfaces disposed in dynamic, non-touching, sealing relation with said pair of parallel wall surfaces of each said cavity, and each said rotor has formed therein a throughflow portion which is formed so as to be brought periodically into communicative association with the interior of said cavity and with said second gas port, so as to facilitate gas communication therebetween.

17. An integrated machine system according to claim 16, wherein each said pair of rotors includes first and second rotors, each having a cylindrical outer surface, arranged for rotation within a predetermined pair of adjoining, respective, first and second bores such that said cylindrical outer surfaces of said first and second rotors are always in dynamic, non-touching, sealing relation with each other.

18. An integrated machine system according to claim 17, wherein, in each said machine, said rotors are operative, during said rotation thereof, to cooperate with said partition walls and predetermined portions of said parallel wall surfaces so as to periodically form working spaces therewith, and wherein said plurality of mutually cooperating machines includes at least first and second machines of which said first machine is an internal combustion engine, and said working spaces thereof are combustion chambers.

19. An integrated machine system according to claim 18, wherein predetermined ones of said first and second gas ports of each said machine are operative to communicate with predetermined others of said first and second gas ports of each said machine, thereby to selectably provide an additional rotational force to said driver.

* * * * *